US011492820B2

(12) United States Patent
Taylor

(10) Patent No.: US 11,492,820 B2
(45) Date of Patent: Nov. 8, 2022

(54) HYBRID OUTDOOR CAMPING SHELTER

(71) Applicant: Steven Caan Taylor, Silverthorne, CO (US)

(72) Inventor: Steven Caan Taylor, Silverthorne, CO (US)

( * ) Notice: Subject to any disclaimer, the term of this patent is extended or adjusted under 35 U.S.C. 154(b) by 0 days.

(21) Appl. No.: 17/552,080

(22) Filed: Dec. 15, 2021

(65) Prior Publication Data

US 2022/0186518 A1 Jun. 16, 2022

Related U.S. Application Data

(60) Provisional application No. 63/222,501, filed on Jul. 16, 2021, provisional application No. 63/199,268, filed on Dec. 16, 2020.

(51) Int. Cl.

| | |
|---|---|
| ***E04H 15/04*** | (2006.01) |
| ***E04H 15/32*** | (2006.01) |
| ***A45F 3/22*** | (2006.01) |
| ***E04H 15/58*** | (2006.01) |

(52) U.S. Cl.

CPC ..... *E04H 15/322* (2013.01); *A45F 3/22* (2013.01); *E04H 15/04* (2013.01); *E04H 15/58* (2013.01)

(58) Field of Classification Search

CPC ..... E04H 15/322; E04H 15/04; A45F 3/22
See application file for complete search history.

(56) References Cited

U.S. PATENT DOCUMENTS

| | | | | | |
|---|---|---|---|---|---|
| 1,116,074 | A | * | 11/1914 | Jones | E04H 15/04 5/413 R |
| 1,239,712 | A | * | 9/1917 | Miles | A45F 3/22 5/120 |
| 1,343,800 | A | * | 6/1920 | Trimm | E04H 15/04 135/96 |
| 4,071,917 | A | * | 2/1978 | Mojica | E04H 15/04 135/96 |
| 4,239,135 | A | * | 12/1980 | Armstrong | E04H 15/30 224/154 |
| 4,471,794 | A | | 9/1984 | Kirkham, Jr. | |
| 4,862,906 | A | * | 9/1989 | Jordon | A45F 3/22 5/120 |
| 7,406,977 | B1 | | 8/2008 | Shires | |
| 10,655,357 | B1 | | 5/2020 | Graham | |

(Continued)

OTHER PUBLICATIONS

Grand Trunk All Terrain Hybrid Shelter, web page <https://www.amazon.com/Grand-Trunk-Terrain-Hybrid-Shelter/dp/B009M5QQP2>, last visited Dec. 15, 2021.

(Continued)

*Primary Examiner* — Noah Chandler Hawk

(57) ABSTRACT

Embodiments in this disclosure include an outdoor shelter for on-ground and suspended use. The outdoor shelter has an enclosure element including a base, two sleeves including a. drawstring, and top straps. :Iii its on-ground configuration, the base and the sleeve lay flat, and the enclosure element is vertically supported by the top straps upon engaging a structural member. In its suspended configuration, the sleeves are bunched and its drawstring is coupled to lift points, and the base defines a catenary between the two lift points. The outdoor shelter may also include a detachable rainfly that overhangs above the enclosure element in both its on-ground and suspended configurations.

18 Claims, 20 Drawing Sheets

(56) References Cited

U.S. PATENT DOCUMENTS

| | | | | |
|---|---|---|---|---|
| 2005/0188460 | A1* | 9/2005 | O'Brien | E04H 15/04 5/120 |
| 2014/0299638 | A1 | 10/2014 | Hutchins | |
| 2016/0213130 | A1* | 7/2016 | Frazer | E04H 15/04 |
| 2022/0010580 | A1* | 1/2022 | Graham | E04H 15/324 |

OTHER PUBLICATIONS

ENO JungleLink Hammock System, web page <https://www.rei.com/product/170035/eno-junglelink-hammock-system?CAWELAID=120217890009375891&CAGPSPN=pla&CAAGID=109431034788&CATCI=pla-892891710709&cm_mmc=PLA_Google%7C21700000001700551_1700350001%7C92700053582160542%7CTOF%7C71700000066692663&gclid=Cj0KCQiAv6yCBhCLARIsABqJTjZx9PlyXyTC3-PnKtLjiKXetCck41lI49YP475lELu-it1PvR1qflwaApbKEALw_wcB&gclsrc=aw.ds>, last visited Dec. 15, 2021.

CRUA Hybrid Set, web page <https://www.cruaoutdoors.com/products/crua-hybrid-hammock-tent-set>, last visited Dec. 15, 2021.

* cited by examiner

HAMMOCK CONNECTION
(AS USED)

SECTION VIEW

HAMMOCK CONNECTION
(SPREAD)

BASE STRAP - TOP VIEW

BASE STRAP - SIDE VIEW

TOP STRAP - TOP VIEW

TOP STRAP - SIDE VIEW

RAINFLY CONNECTION - TOP VIEW

RAINFLY CONNECTION - SIDE VIEW

HYBRID OUTDOOR CAMPING SHELTER

CROSS REFERENCE TO RELATED APPLICATIONS

This application claims the benefit of U.S. Provisional Patent Application No. 63/199,268, filed on Dec. 16, 2020 and U.S. Provisional Patent Application No. 63/222,501, filed on Jul. 16, 2021, the contents of which are herein incorporated by reference in their entirety.

TECHNICAL FIELD

Embodiments of the present disclosure are related to camping equipment. More specifically, the present disclosure relates to shelters and furniture for outdoor use.

BACKGROUND

Camping has been done throughout the world in a wide range of weather and terrains. Camping equipment includes tents, hammocks, trailers, tarp shelters, cots, and bivy sacks. Tents are common ground-supported equipment for camping, varying widely in size, weight, shape, and cost. Hammocks allow a user to be suspended above ground and swing. Hammocks can be used for recreation, sleeping, or survival. Like tents, hammocks vary widely in size, weight, shape, and cost.

BRIEF SUMMARY

Embodiments of the present disclosure relate to a hybrid outdoor shelter for camping. Specifically, some embodiments relate an outdoor shelter for on-ground and others for suspended use. In some embodiments, the outdoor shelter includes an enclosure element having a base, and two sleeves having drawstrings. In its on-ground configuration, the base and the sleeves are designed to lay flat upon an underlying surface, and the enclosure element is configured to be vertically supported upon engaging a structural member. In some embodiments, the sleeves are coupled to the base. Furthermore, the outdoor shelter, in some embodiments, includes a first top strap and a second top strap designed to engage the structural member. The first and second top straps may be coupled to the enclosure element. In its suspended configuration, each sleeve is bunched and the drawstrings are coupled to lift points. In this configuration, the base is suspended, defining a catenary between the first and the second lift points.

Some embodiments of the present disclosure include a rainfly. The rainfly can have attachment points that couple to the top straps of the outdoor shelter, and securing points that couple to anchor points. The rainfly can be used in an on-ground configuration or in a suspended configuration. In both configurations, the rainfly can vertically overhang over a substantial portion of the outdoor shelter.

Some embodiments of the present disclosure relate to a sleeve system for a hybrid tent and hammock. This sleeve system has a fabric loop, a connection end, an opposite end, and two entry points, in some embodiments. The sleeve is configured to lay flat in an on-ground configuration and to be bunched in a suspended configuration. The sleeve is of adequate strength to support a user's weight against gravity and/or additional camping gear. The connection end is longer than the opposite end, in some embodiments. The fabric loop couples at the connection end. Furthermore, the first entry point and the second entry point may have reinforced fabric. According to some embodiments, the first entry point is not parallel to the second entry point. In some embodiments, a drawstring is looped through the first entry point, through the sleeve, and through the second entry point.

According to some embodiments, the enclosure element has zippers. The zippers couples the sides or portions of the enclosure element to the base. In some embodiments, the zippers are curved at the corners.

While the disclosure is amenable to various modifications and alternative forms, specific embodiments have been shown by way of example in the drawings and are described in detail below. However, these examples are not limiting. The present disclosure covers all modifications, equivalents, and alternatives falling within the scope of the disclosure as defined by the claims.

DETAILED DESCRIPTION

Figure 1:
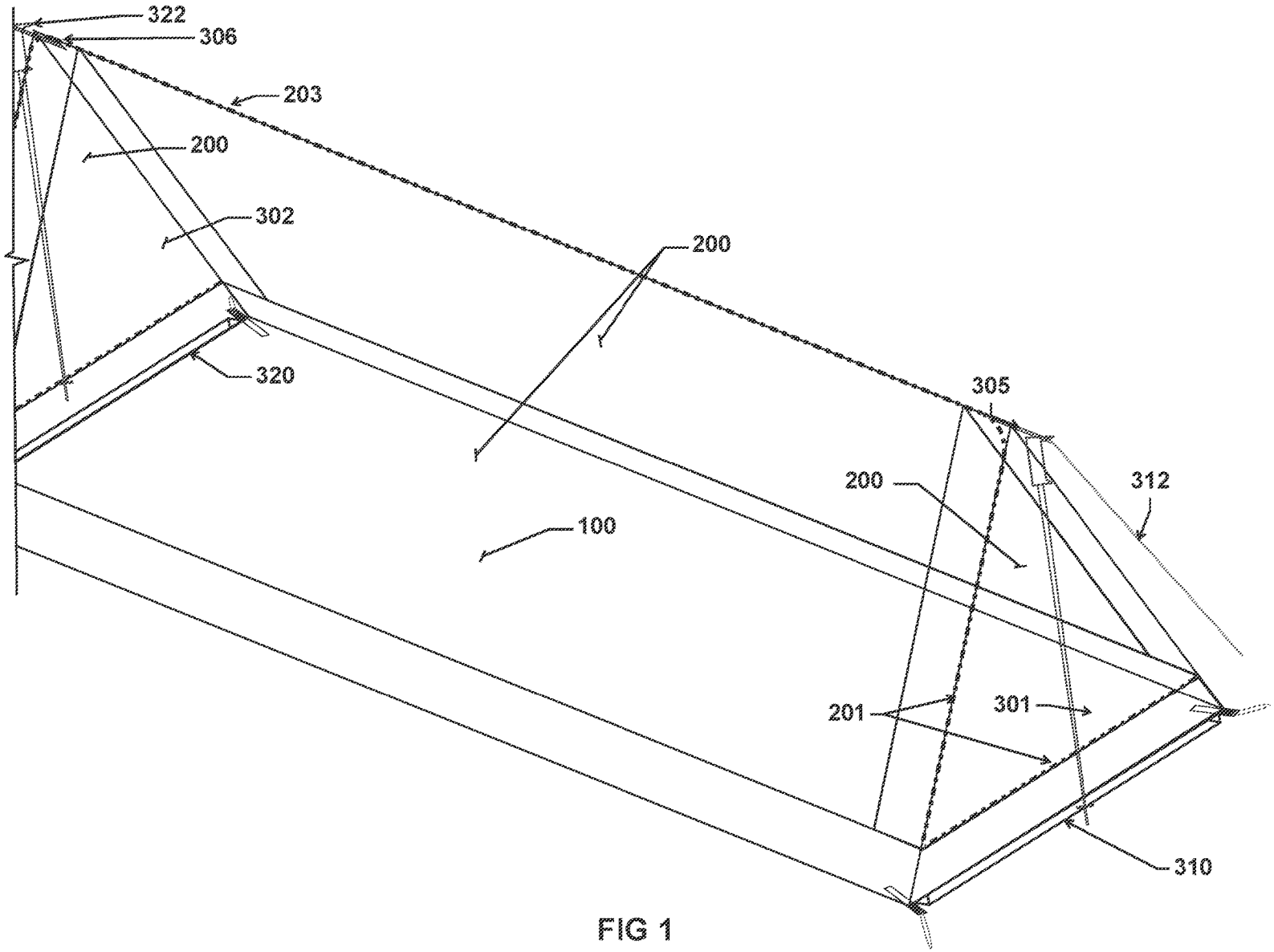
FIG. 1 shows an isometric view of the outdoor shelter in a tent configuration, according to some embodiments of the present disclosure.
Figure 19:
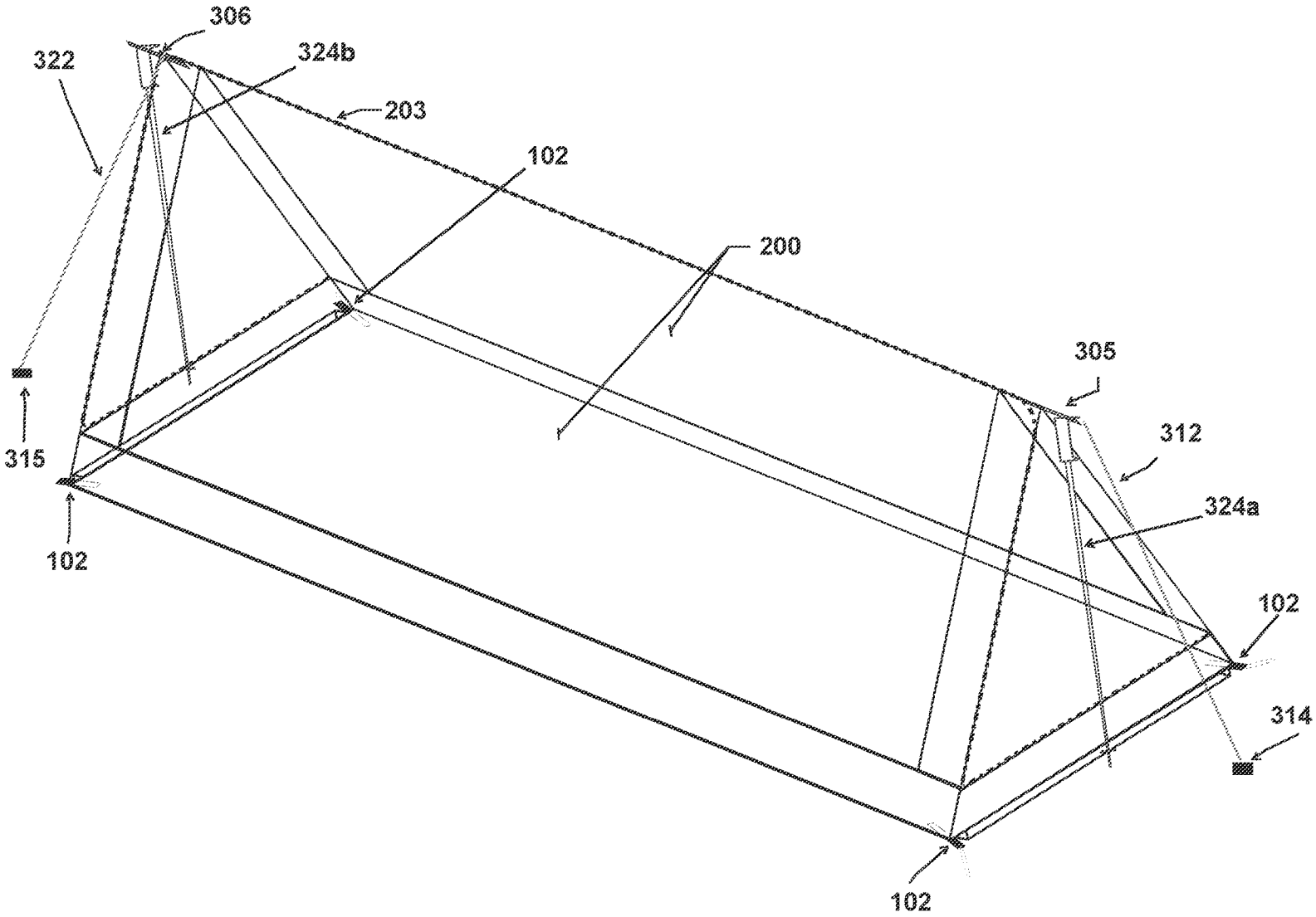
FIG. 19 shows an isometric view of the outdoor shelter, with a structural member and guylines attached, according to some embodiments of the present disclosure.

FIG. 1 shows one embodiment of an outdoor shelter in an on-ground configuration (e.g. a first configuration). Embodiments of the outdoor shelter include an enclosure element 200 with a base 100, a first sleeve 310, a second sleeve 320, a first top strap 305, and a second top strap 306. Each sleeve may include a drawstring 304, which is looped through the first sleeve or the second sleeve. In some embodiments, a single side of the drawstring loop is inserted through the sleeve. In other embodiments, the drawstring 304 may be a single portion of high strength rope material passing through the sleeve, with the drawstring 304 having eyelets ends for connection to a lift point. The drawstring material may be, for example, paracord, rope, wire, rigging, or webbing. According to some embodiments, the first top strap 305 and the second top strap 306 are configured to engage a structural member 324, as shown in FIG. 19. The structural member 324 can include, among others, trekking/hiking poles, sticks, logs, poles, stumps, tripods, and the like. In the first configuration, the base 100 is configured to lay flat upon an underlying surface, the first sleeve 310 and the second sleeve 320 lay flat. In such configuration, the enclosure element 200 is configured to be vertically supported by a first structural member 324*a* engaged with the first top strap 305 and a second structural member 324*b* engaged with the second top strap 306, at least partially suspending the enclosure element 200. In some embodiments, the enclosure element is in the form of a prism, comprising several sides. In one embodiment, when the structural member 324 is engaged to the top straps 305 and 306, the sides may be suspended with respect to the base 100. The enclosure element 200 may have a ridgeline 203 along its length. Such ridgeline 203 may provide additional shape and structural rigidity to the outdoor shelter, in a first configuration. The base 100, according to some embodiments, may be constructed from waterproof lightweight polyester, nylon fabric, breathable fabrics, or any combination of the options. In some embodiments, the base 100 may also include bottom straps 102 that may be used to attach the base 100 to ground stakes or other securing means. The bottom straps 102 can be webbing, cordage loops, hooks, or the like. The first top strap 305 and the second top strap 306 may also be coupled to a first guyline 312 and a second guyline 322, respectively. As shown in FIG. 19, in some embodiments, a first extremity of the first guyline 312 is coupled to the first top strap 305 and a second extremity of the first guyline 312 is coupled to a first anchor point 314, while a first extremity of a second guyline 322 is coupled to the second top strap 306 and a second extremity of the second guyline 322 is coupled to a second anchor point 315. When the first guyline 312 and the second guyline 322 are tensioned, as shown in FIG. 1, the enclosure element is supported laterally, in some embodiments, by adding tension across the enclosure element's 200 ridgeline 203 and keeping the fabric taught. Seam locations and zipper orientations may also add structural rigidity to help support the outdoor shelter in its first configuration both vertically and laterally, according to some embodiments.

According to some embodiments, as shown in FIG. 1, the enclosure element 200 also includes at least one zipper 201. Portions of the enclosure element may be coupled to the base 100 at the zipper 201. In some embodiments, the enclosure element may comprise different sides, each with a zipper along its boundary, coupling to each side at the zipper. The zippers 201, in some embodiments, have the ability to have a fully enclosed interior, one side open, multiple sides open, or fully opened according to the user's preferences and needs. Other embodiments may include other closure mechanisms such as Velcro, magnets, glue, eyes and hooks, snaps, buttons, latches, zip ties, ties, and the like. In some embodiments, the zippers are curved at the corners. Areas of the outdoor shelter around edges or proximate to zippers 201 may include waterproof fabric wraps.

Figure 2:
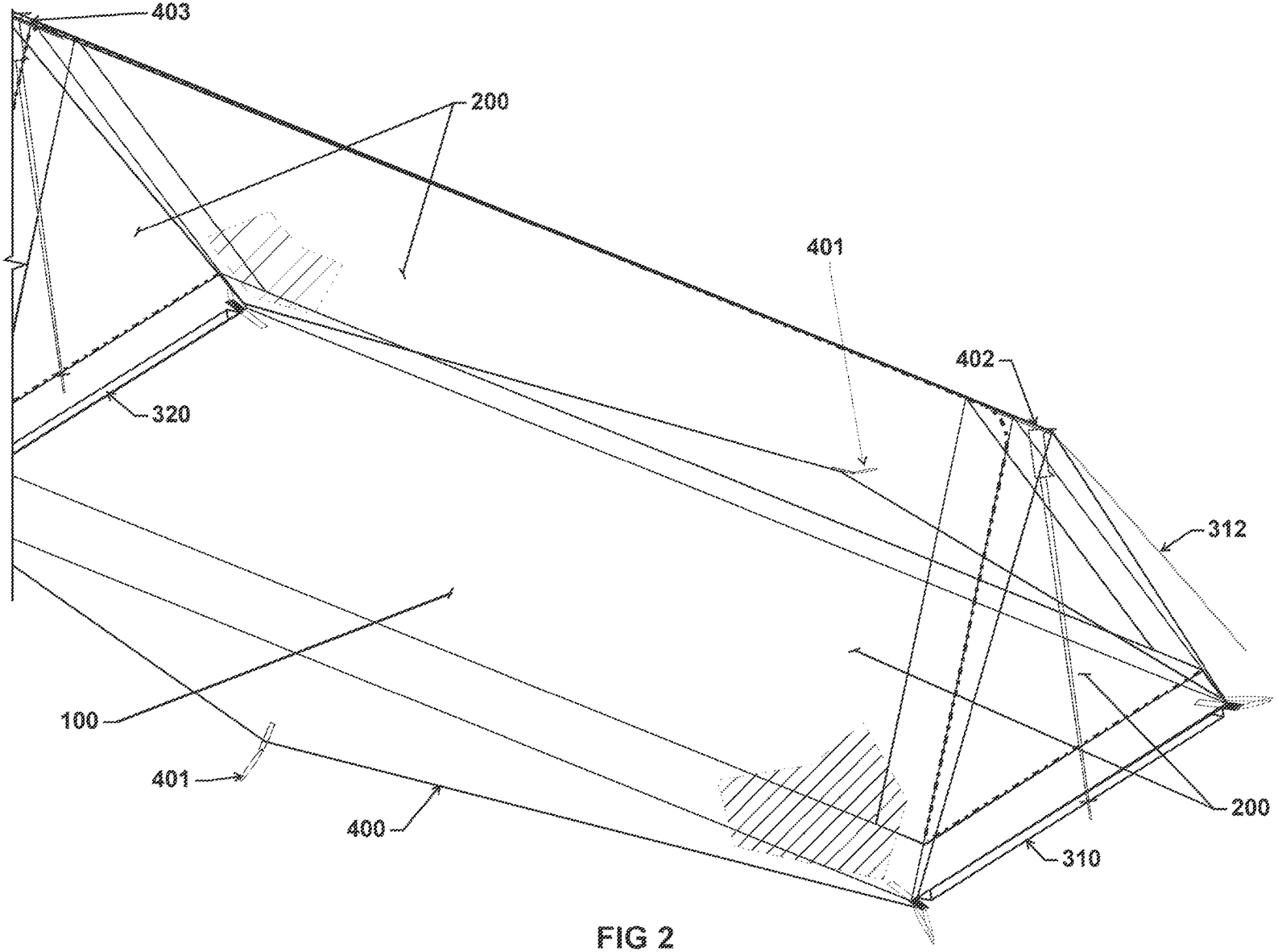
FIG. 2 shows an isometric view of the outdoor shelter in a tent configuration with a rainfly attached, according to some embodiments of the present disclosure.
Figure 10:
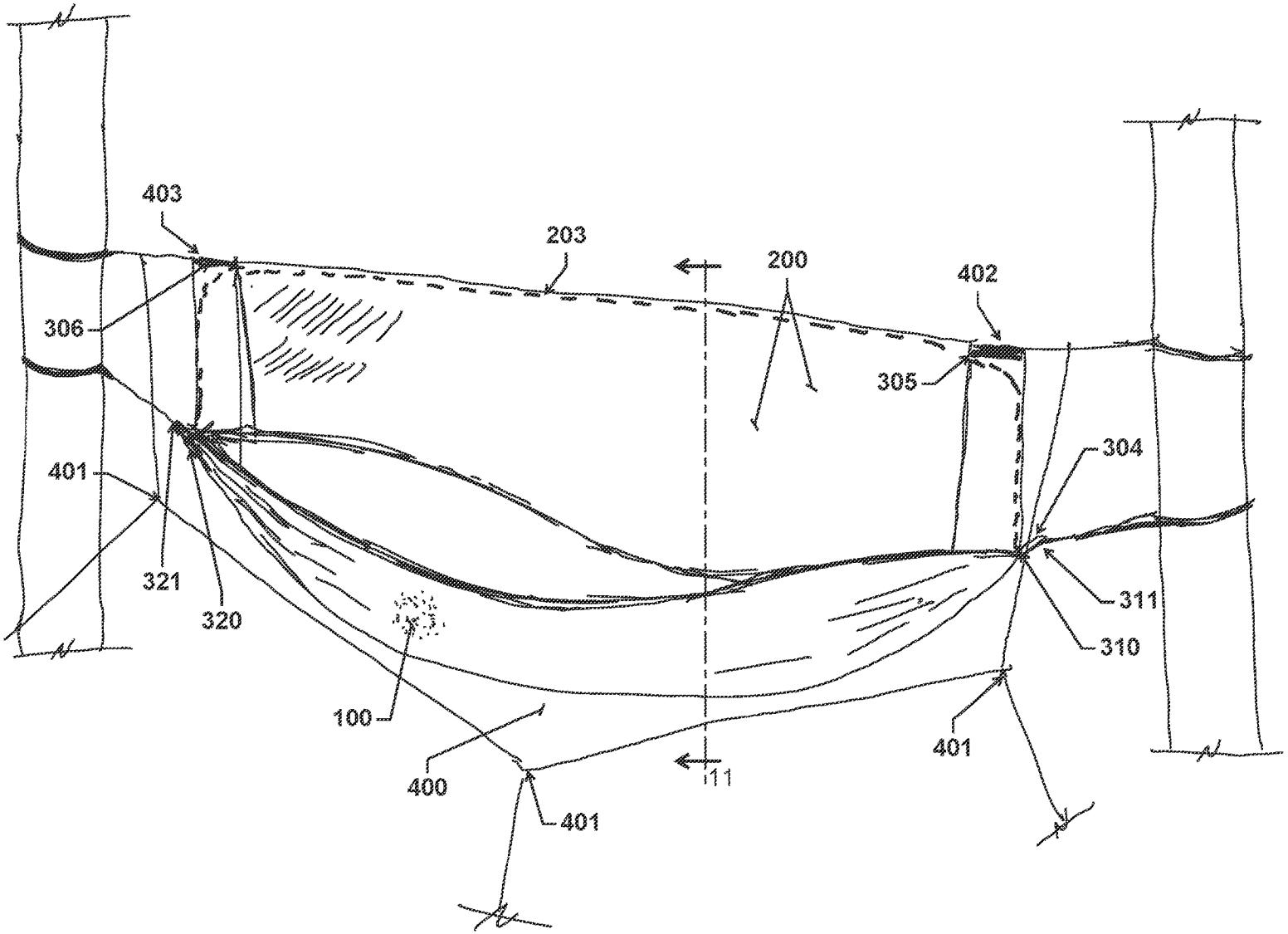
FIG. 10 shows the outdoor shelter in the hammock configuration with the rainfly attached, according to some embodiments of the present disclosure.

As illustrated in FIG. 2, the outdoor shelter of the present disclosure includes a rainfly 400. The rainfly 400 may be detachable. The rainfly 400 has a first attachment point 402, a second attachment point 403, and several securing points 401, in some embodiments. In a first configuration, the first attachment point 402 is coupled to the first top strap 305, the second attachment point 403 is coupled to the second top strap 306, and each of the securing points 401 are secured to anchor points such that the rainfly vertically overhangs over a substantial portion of the enclosure element 200. In a second configuration, as illustrated in FIG. 10, the first attachment point 402 is coupled to a first tie point, a second attachment point 403 is coupled to a second tie point, and each securing point 401 is secured to anchor points such that the rainfly 400 vertically overhangs over a substantial portion of the enclosure element 200. According to some embodiments, in the second configuration, the rainfly 400 angles from the ridgeline 203. In such embodiment, the rainfly 400 does not interfere with the first sleeve 310, or the second sleeve 320, or with the lift points of the outdoor shelter. In some embodiments of the second configuration, portions of the enclosure element 200 are vertically offset by securing the first top strap 305 and the second top strap 306 to a first attachment point 402 and a second attachment point 403 above the first lift point 311 and the second lift point 321. In such embodiment, the suspended shelter creates a fully enclosed cavity. The rainfly 400, can be made from a waterproof lightweight polyester fabric. In other embodiments, the rainfly 400 can be made from nylon, vinyl, polyurethane, waxed cotton, microfiber, wool, neoprene, or the like. In some embodiments, the center of the rainfly runs across the ridgeline 203 of the enclosure element 200. Some securing points 401 may also be secured to the corner straps at the base 100. In some embodiments, the rainfly 400 covers the entire enclosure element 200, inclusive of the base 100. Each of the securing points 401 may be made of straps, hooks, loops, among others. In some embodiments, the rainfly 400 follows the general shape of the outdoor shelter in its on-ground configuration. The rainfly 400 does not interfere with the structural support members, according to some embodiments.

Figure 3:
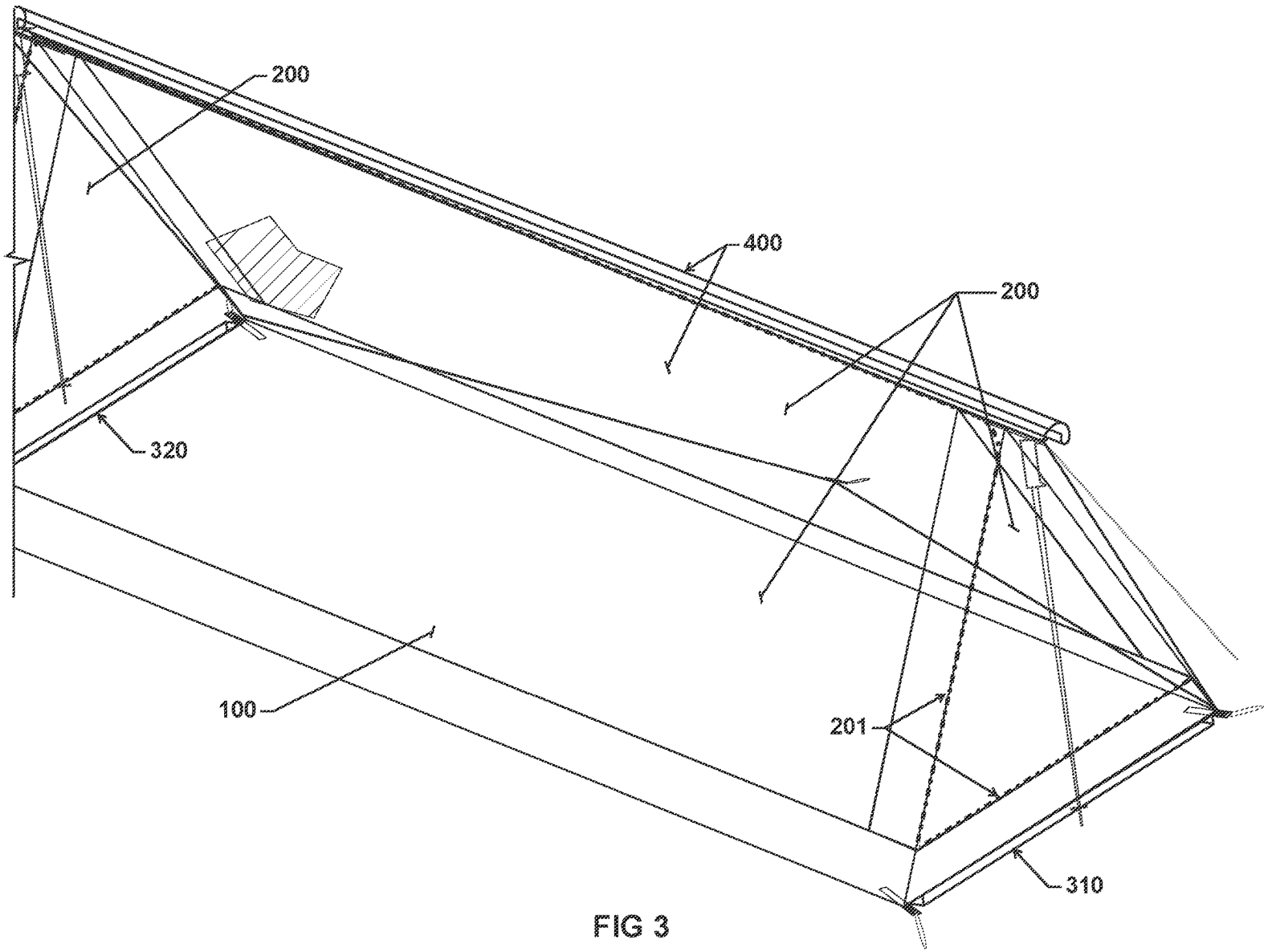
FIG. 3 illustrates an isometric view of the outdoor shelter in a tent configuration with the rainfly rolled as to cover only part of the tent, according to some embodiments of the present disclosure.
Figure 4:
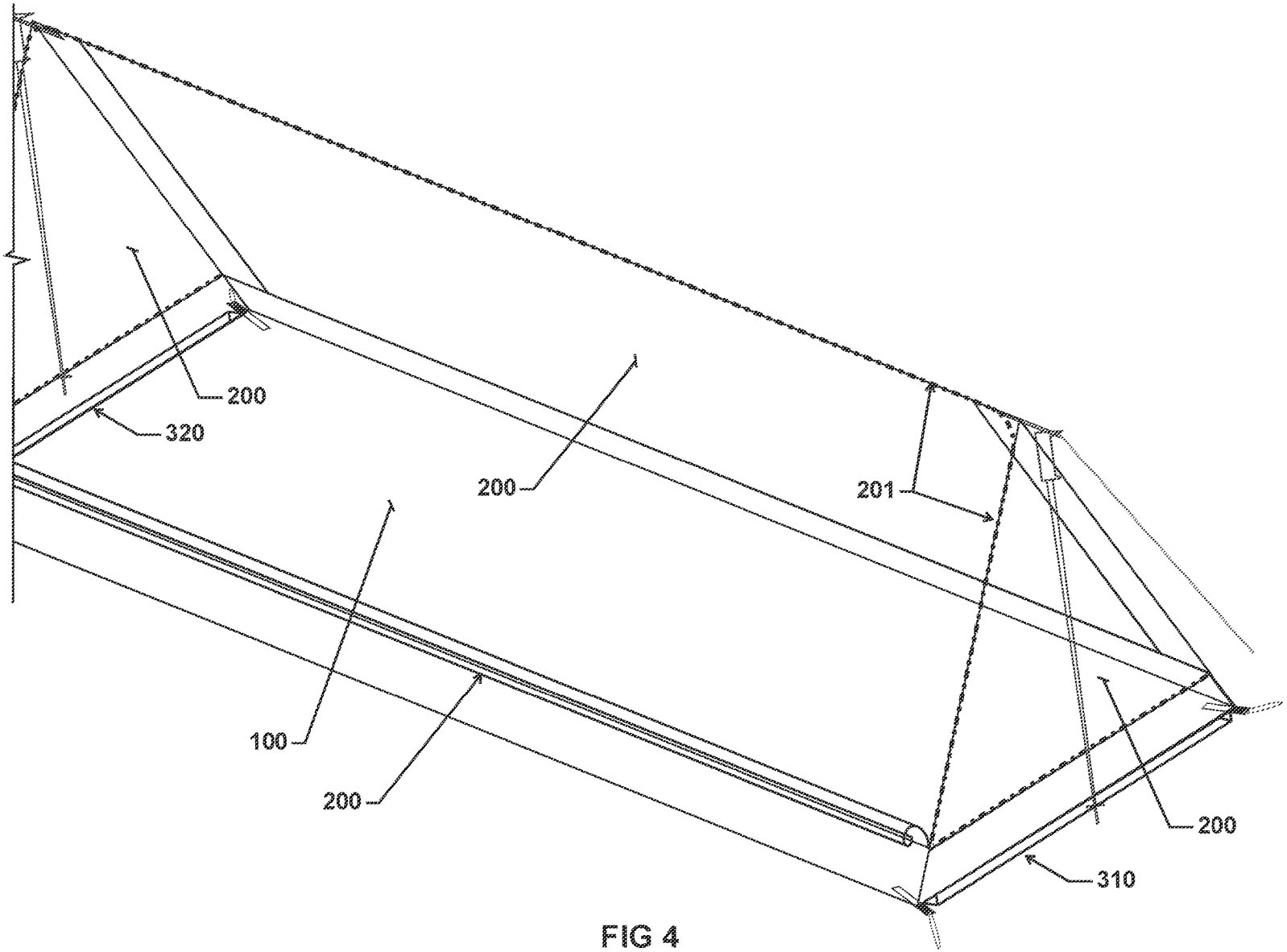
FIG. 4 shows an isometric view of the outdoor shelter in a lean-to orientation, according to some embodiments of the present disclosure.
Figure 5:
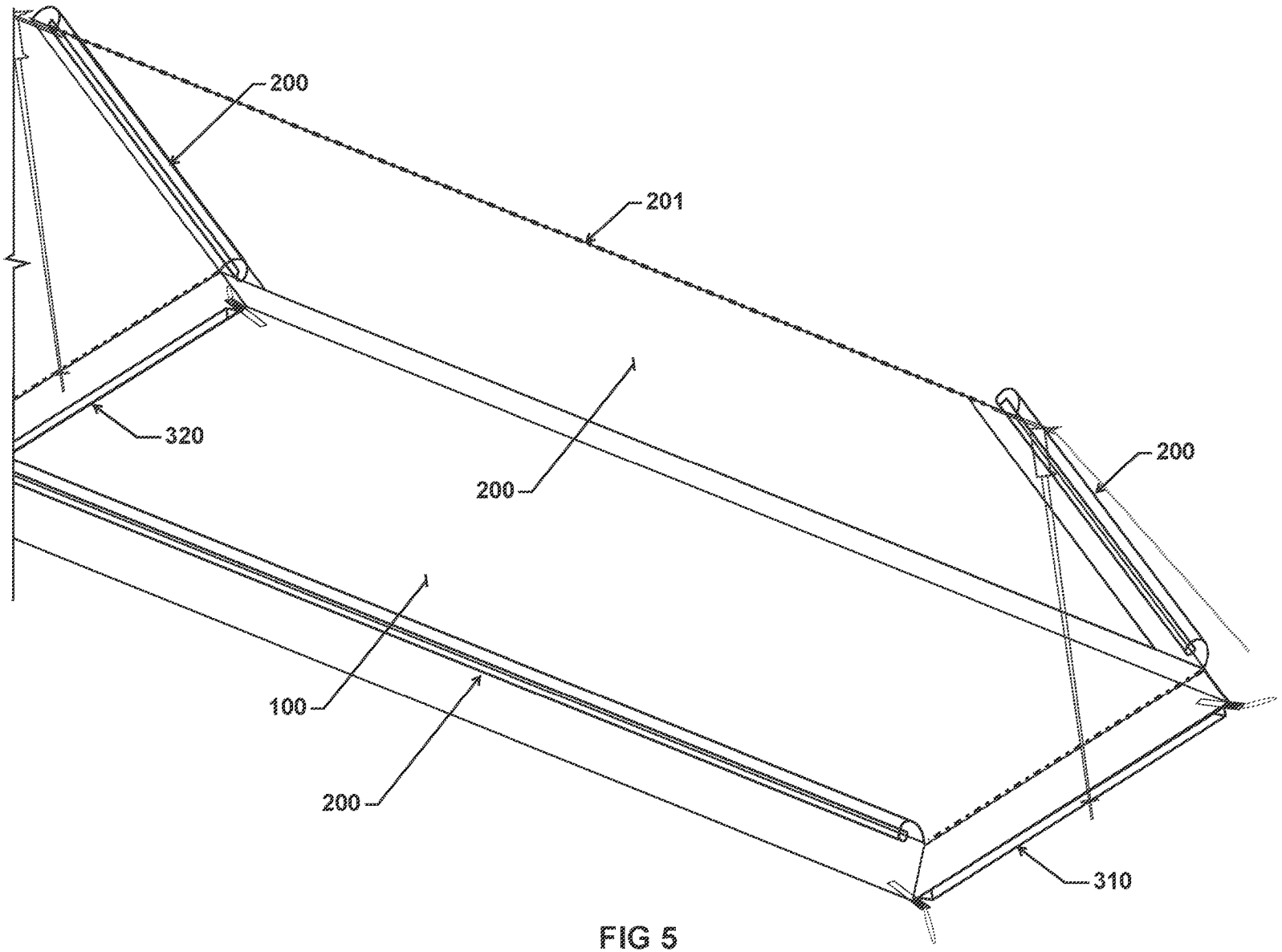
FIG. 5 shows the lean-to orientation of FIG. 4 with the ends open, according to some embodiments of the present disclosure.
Figure 6:
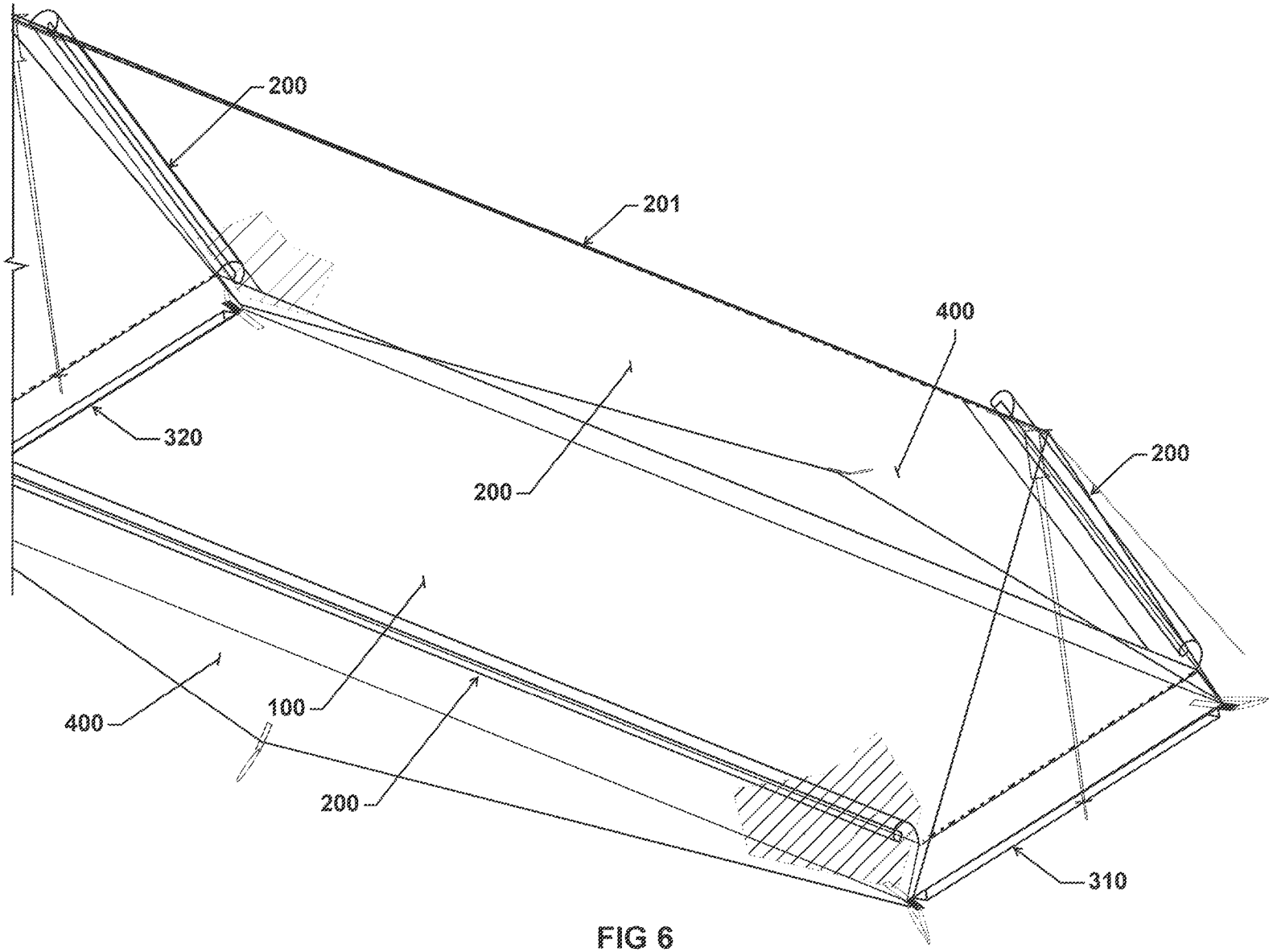
FIG. 6 illustrates an example of the lean-to orientation with a rainfly attached.

According to some embodiments, as illustrated in FIG. 3, portions of the rainfly 400 can be flipped or rolled to the ridgeline 203. In such embodiment, the rainfly 400 covers a portion of the enclosure element, depending on a user's preference. Loops or buttons may be used to secure the rainfly to the desired position, as shown in FIG. 3. As presented in FIG. 4, in some embodiments, portions or sides of the enclosure element 200 may be opened via zippers 201. In such embodiment, the sides or portions of the enclosure element can be rolled towards the base 100 to create a "lean-to " structure with sheltered ends for easier access, according to the user's needs and preferences. Additional sides or portions of the enclosure element 200 may also be rolled or flipped, as illustrated in FIG. 5. In such embodiment, the sides or portions of the enclosure element 200 may be rolled towards the closed sides or towards the base, depending on the configuration of the shelter in the on-ground position. FIG. 6 shows the lean-to orientation of FIG. 5 with a rainfly 400 attached. In the FIG. 6 embodiment, a rainfly 400 may be attached to provide the user additional protection from the elements while portions of the enclosure element 200 remain open for additional airflow or easier access.

Figure 7:
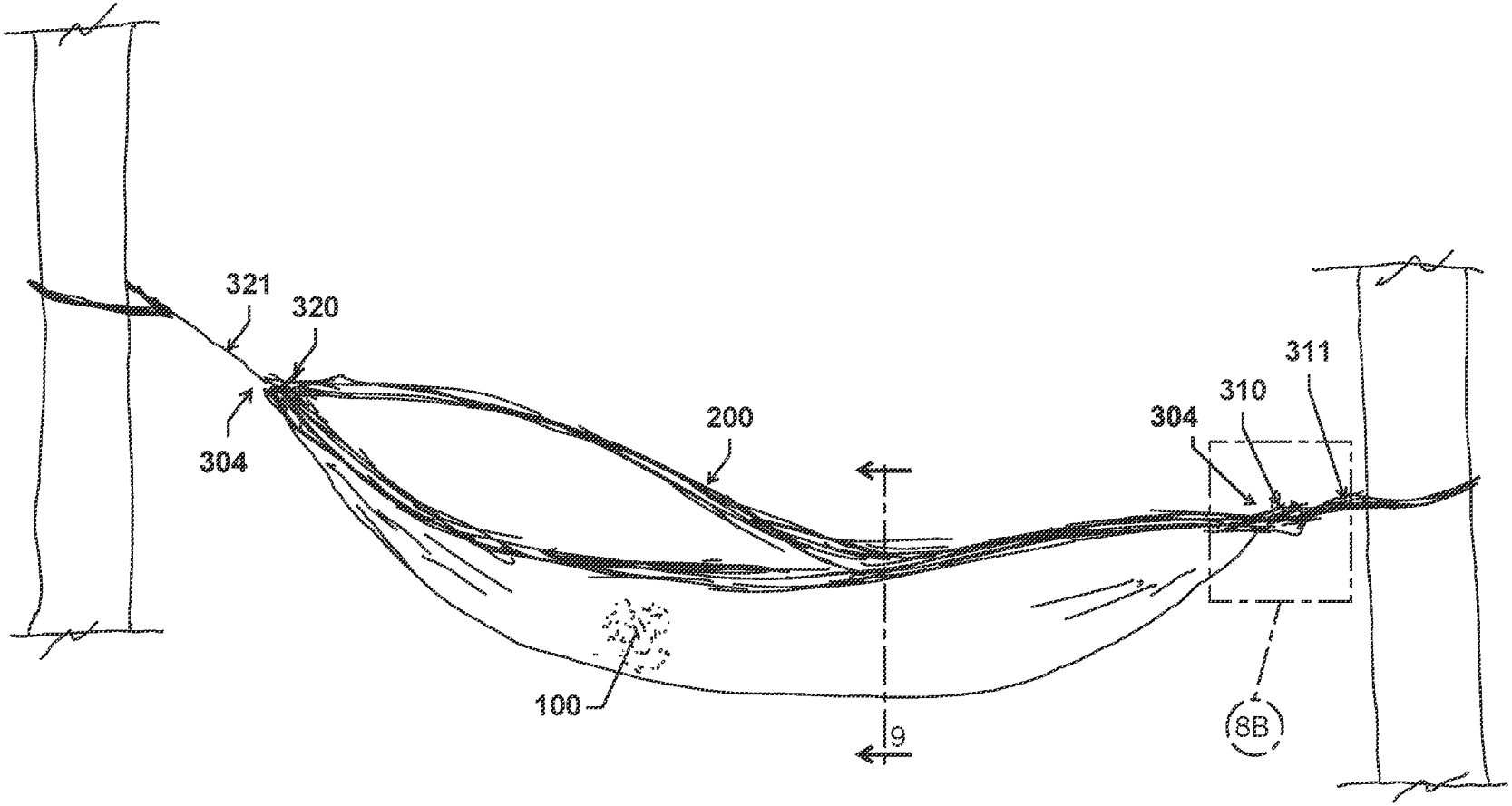
FIG. 7 shows the outdoor shelter in a hammock configuration, according to some embodiments of the present disclosure.
Figure 9:
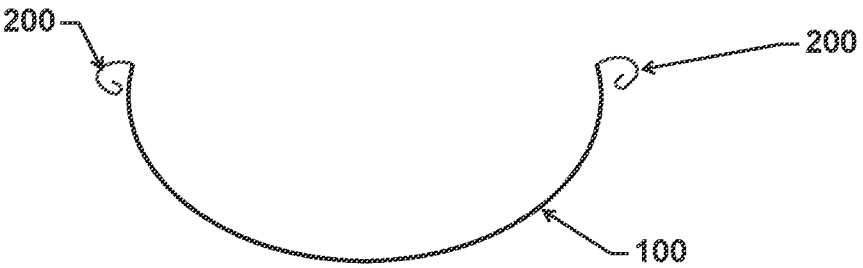
FIG. 9 illustrates a cross-sectional view, along line 9 of FIG. 7, of the outdoor shelter in a hammock configuration, according to some embodiments of the present disclosure.

FIG. 7, according to some embodiments of the present disclosure, shows the second configuration of the outdoor shelter. In this configuration, the first sleeve 310 is bunched and the drawstring 304 is coupled to the first lift point 311; the second sleeve 320 is bunched and the drawstring 304 is coupled to a second lift point 321; and the base 100 defines a catenary between the first lift point 311 and the second lift point 321. In this configuration, the sleeves are configured to support a user's weight against gravity. Furthermore, in some embodiments, the base is configured to comfortably support a user in a hammock configuration. In some embodiments, upon suspending the outdoor shelter, portions or sides of the enclosure element 200 can be rolled or tucked in to the base 100, as presented in FIG. 9. The first lift point 311 and the second lift point 321 may be attached to a tree or other end support capable of withstanding the required loads. The lift points may be attached to the drawstring by a carabiner, shackle, knot, ring, buckle, hoist, hooks, turnbuckle, swivels, and the like.

Figure 8B:
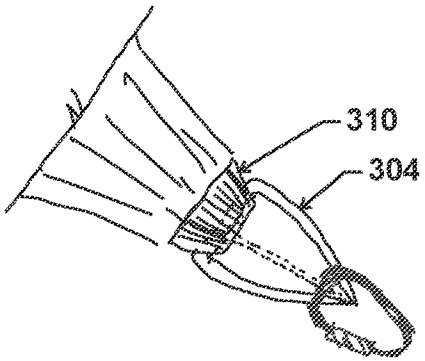
FIG. 8B shows the sleeve of FIG. 8A, as seen in view 8B of FIG. 7, in a bunched configuration, according to some embodiments of the present disclosure.
Figure 8C:
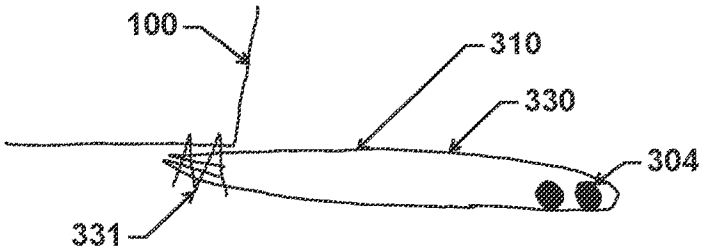
FIG. 8C shows a cross-sectional view, taken along line 8C of FIG. 8A, of the sleeve of FIG. 8A, according to some embodiments of the present disclosure.
Figure 8A:
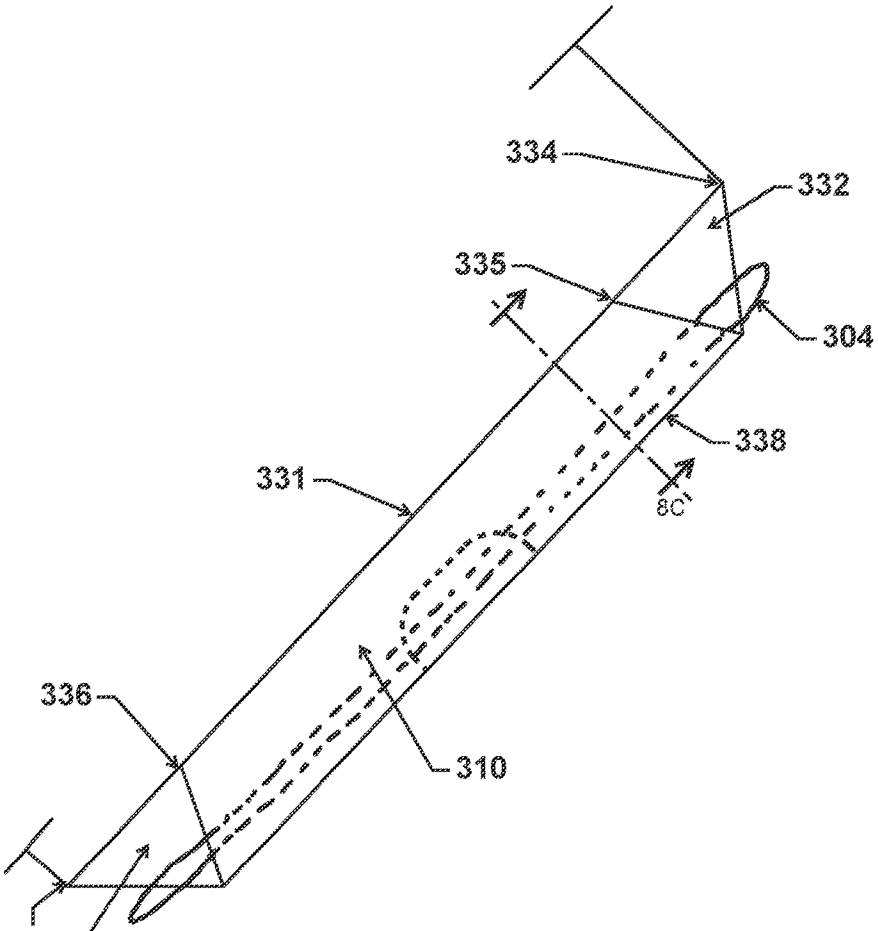
FIG. 8A shows a plan view of the sleeve and the drawstring in a flat configuration, according to some embodiments of the present disclosure.
Figure 20:
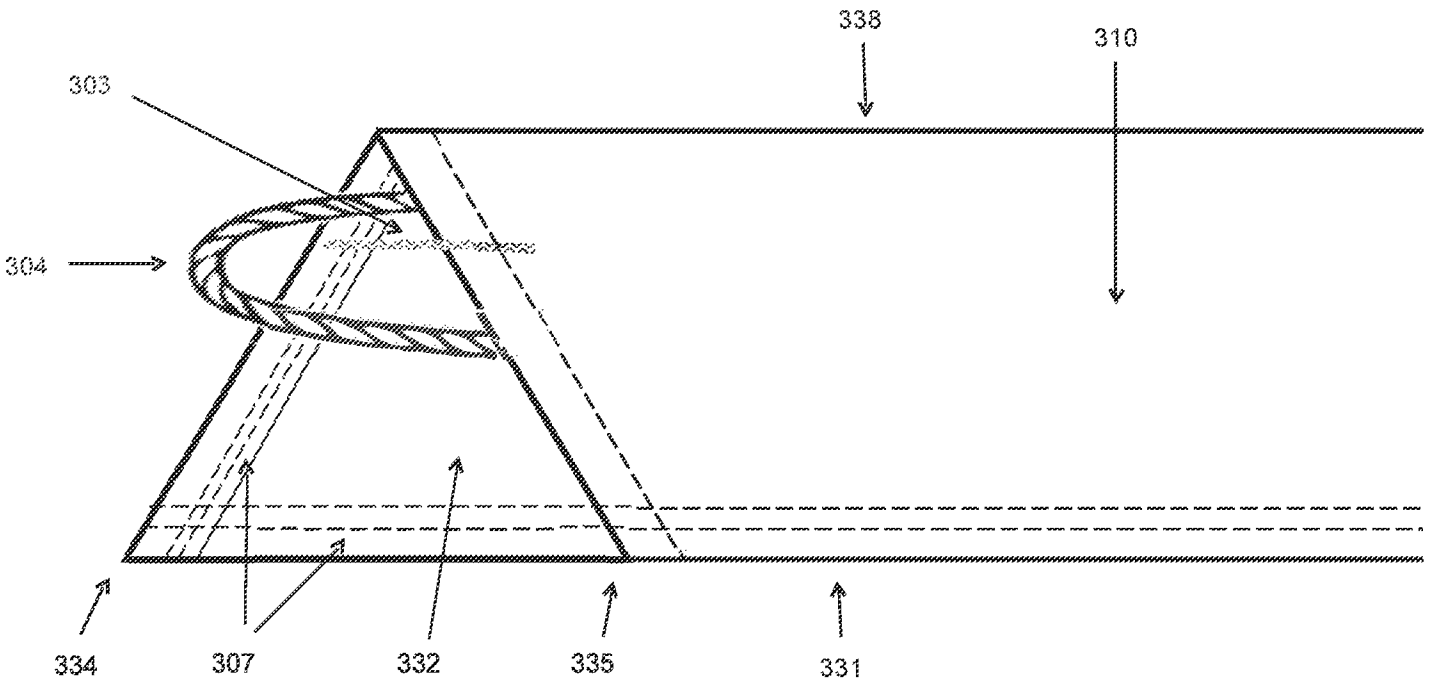
FIG. 20 shows a zoomed in version of FIG. 8, with the ends of the sleeve shown.

According to some embodiments, as shown in FIG. 8A, the sleeve for a hybrid tent and hammock includes a fabric loop 330 (as shown in FIG. 8C), a connection end 331, an opposite end 338, a first entry point 332, and a second entry point 333. The connection end 331 is longer than the opposite end 338, in some embodiments. Furthermore, the connection end 331 can be configured to couple to a body, a base 100, or the enclosure element 200 of a tent, or a hybrid tent and hammock. Each first 332 and second 333 entry points may have reinforced fabric. In some embodiments, the first entry point 332 and the second entry point 333 are not parallel. The angled fabric in each of the first entry point 332 and the second entry point 333 may reduce point loading on the sleeve, or on the overall system, and may spread the load more evenly. In the on-ground configuration, the first sleeve 310 and the second sleeve 320 lays flat or is able to extend thus not interfering with the tent base 100 in this embodiment. In the suspended or hammock configuration, as presented in FIG. 8B, the first sleeve 310 and the second sleeve 320 bunches or cinches together serving as a lift point of the structure and supports the outdoor shelter when it is lifted. This design also reduces the point loading and reduces the probability of slack in the drawstring 304 while suspended, in some embodiments. The first sleeve 310 and the second sleeve 320 may have an optional center opening in the fabric for passing a cord or drawstring 304 through the sleeve. In other embodiments, the first sleeve 310 and the second sleeve 320 may have multiple openings throughout its length. The fabric loop 330, as illustrated in FIG. 8C, is coupled at the connection end 331. Such loop may be sewn or attached to the base 100 by various sewing techniques, gluing, or other outdoor equipment construction techniques. The fabric loop 330 may have multiple layers of fabric. In some embodiments, as shown in FIG. 20 and FIG. 8A, the first sleeve 310 and the second sleeve 320 includes four corners of the fabric loop, 334/335/336/337; each of the corners are coupled at the connection end 331 in an arrangement such that the corners are not lined up and do not intersect. The first sleeve 310 and the second sleeve 320 may also include a first entry point 332 and a second entry point 333 which may have reinforced ends 307. In some embodiments, the sleeve comprises a drawstring 304, which extends through the first entry point 332, through the sleeve 310, and through the second entry point 333. The drawstring 304, in some embodiments, is a loop extending through the sleeve 310. In such embodiment, the first sleeve 310 and the second sleeve 320 can include additional stitching 303 running parallel to the connection end 331 or the opposite end 338, that maintains the drawstring loop within the sleeve. The stitching, in that embodiment, is located at each the first entry point 332 and the second entry points 333. In other embodiments, a single side of a loop is within the sleeve or the drawstring is a single piece of cord with eyelet ends for easier connection to the lift points.

Figure 11:
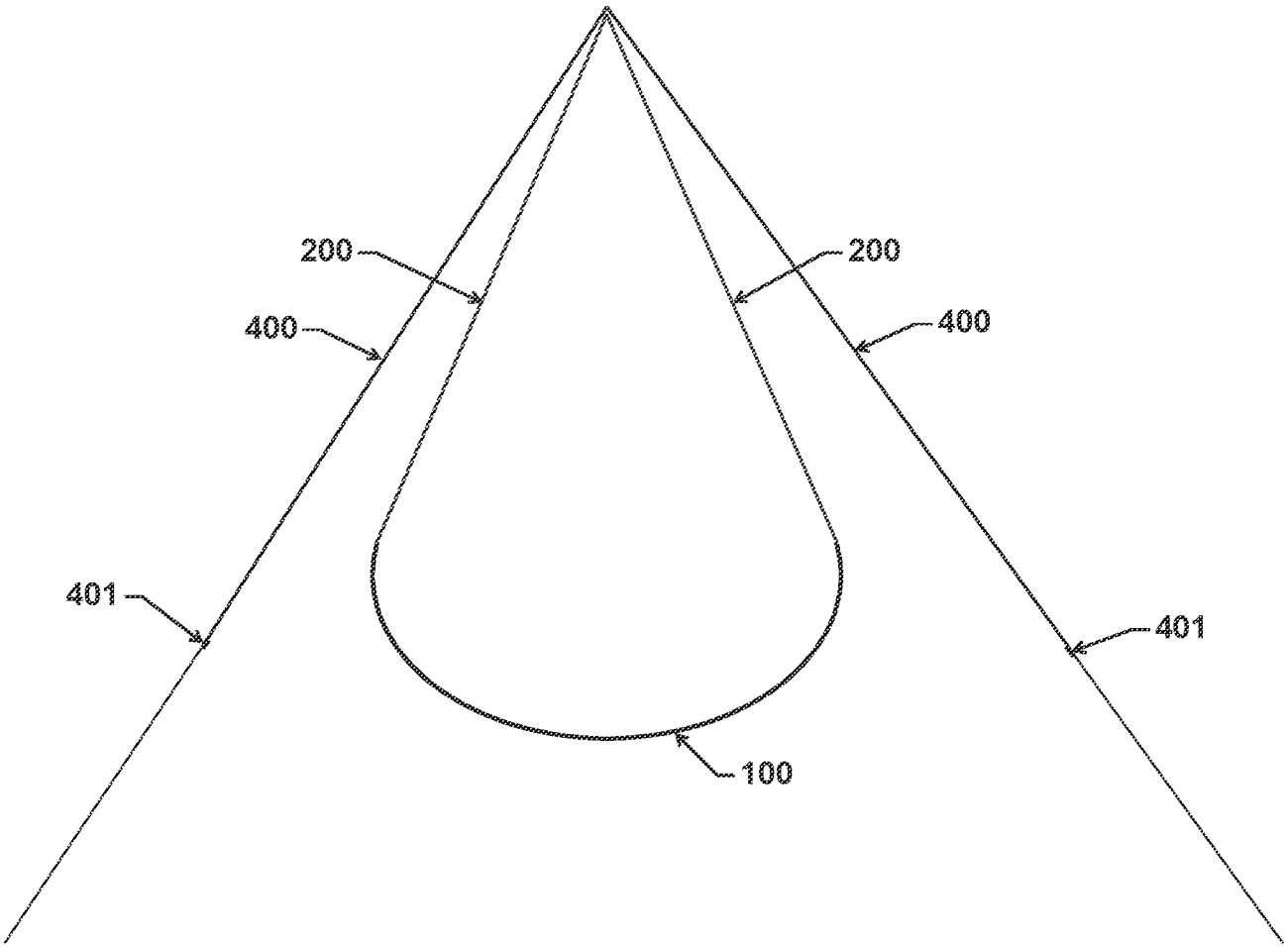
FIG. 11 illustrates a cross-sectional view, taken along line 11 of FIG. 10, of the hammock configuration shown in FIG. 10, according to some embodiments of the present disclosure.

FIG. 10, according to some embodiments, shows a second configuration of the outdoor shelter with the rainfly 400. In this configuration, the first top strap 305 is coupled to the first attachment point 402 and the second top strap 306 is coupled to the second attachment point 403. The first attachment 402 and the second attachment 403 points are above the first point 311 and second lift point 321, according to some embodiments. In some embodiments, the distance between the first lift point 311 and the first attachment point 402, and the second lift point 321 and the second attachment point 403 is such that a user can sit comfortably without contacting the top of the ridgeline 203 of the enclosure element 200. In the embodiment shown in FIG. 10, the rainfly 400 is coupled via the first attachment point 402 to the first top strap 305 and via the second attachment point 403 to the second top strap 306. The rainfly 400 may have three securing points 401 on each side of the enclosure element 200. In some embodiments, the rainfly 400 completely covers the enclosure element 200, as illustrated in FIG. 11. A space beneath the base 100 in the suspended configuration and an underlying surface may be used as a dry zone and for gear storage. In some embodiments, the enclosure element 200 is constructed of mesh walls.

Figure 12:
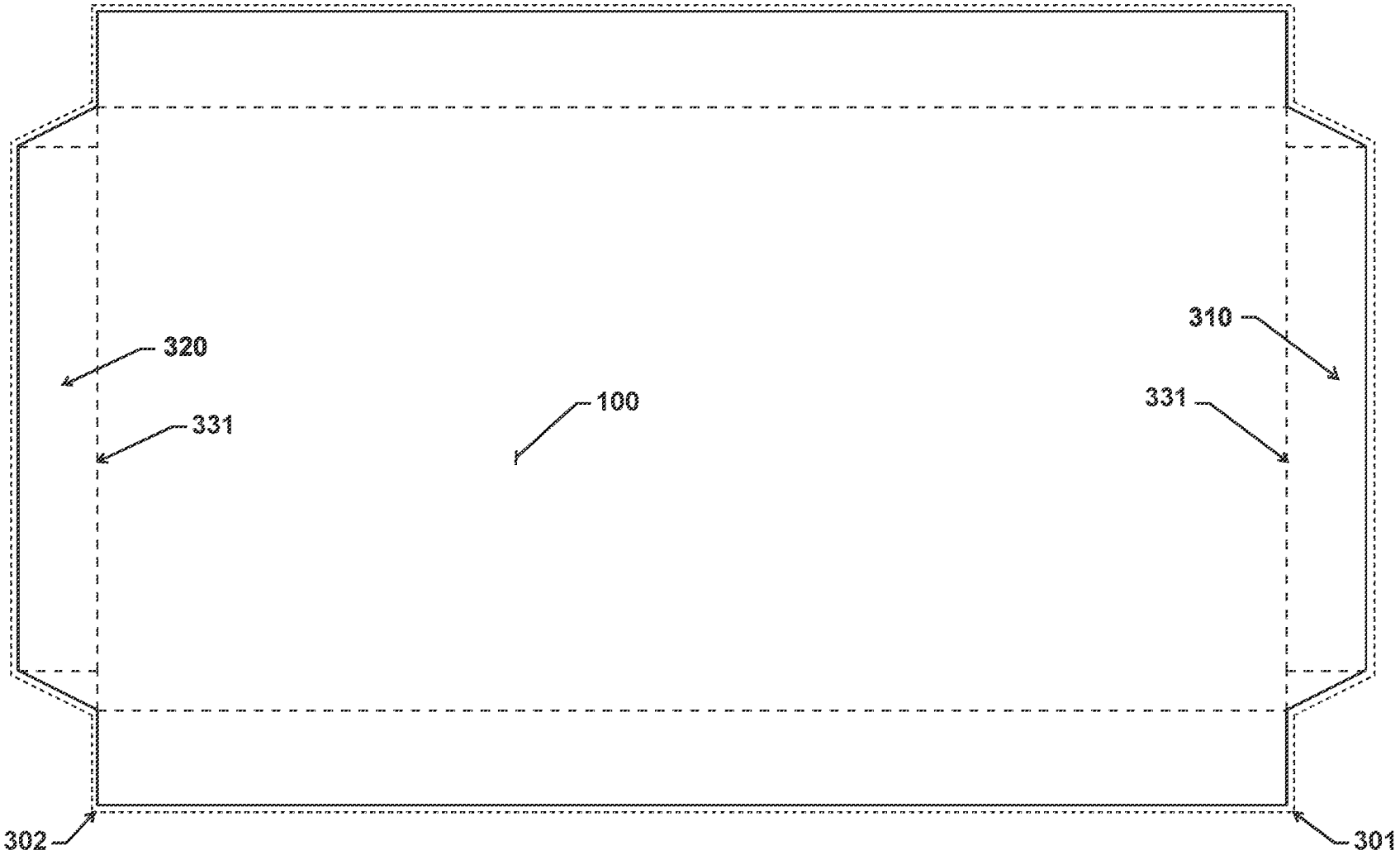
FIG. 12 shows a plan view of the base of the outdoor shelter, according to some embodiments of the present disclosure.

FIG. 12, according to some embodiments of the present disclosure, illustrates the cut shape of the base 100. In some embodiments, the first sleeve 310 and the second sleeve 320 (see, e.g., FIG. 8A) are coupled to the base 100. In such embodiment, the first sleeve 310 is coupled to the base 100 at a first end 301, and the second sleeve 320 is coupled to the base 100 at a second end 302. The base may be made from a single piece of fabric. In some embodiments, the connection end 331 of the first sleeve 310 and the second sleeve 320 is substantially the same length as the width of the base 100 that is in contact with the ground or an underlying surface.

Figure 13B:
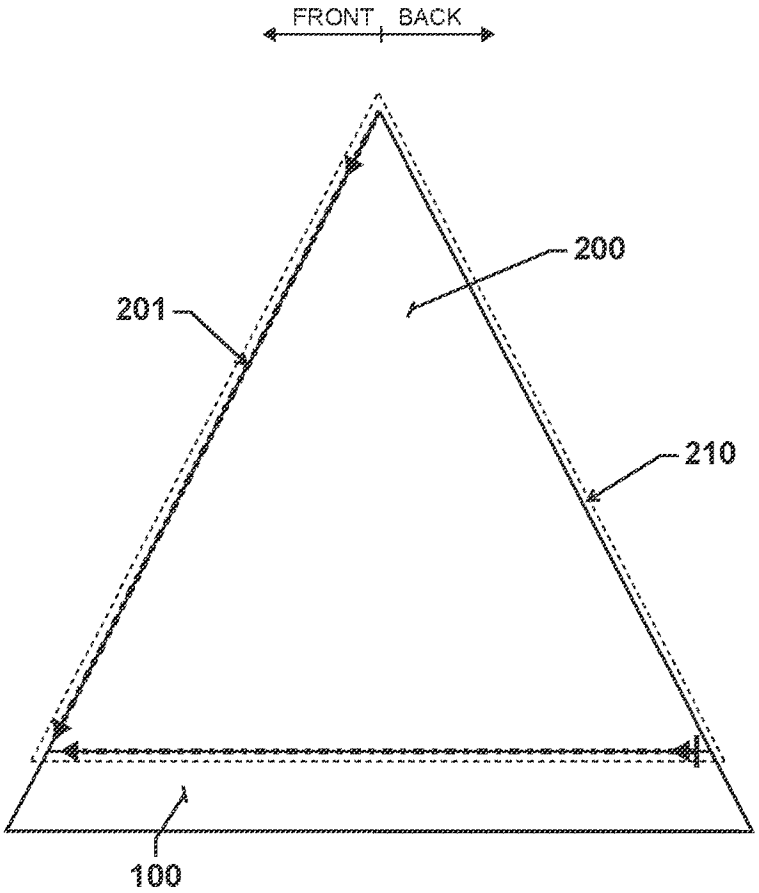
FIG. 13B shows a view of the left side of the outdoor shelter in a tent configuration, according to some embodiments of the present disclosure.
Figure 13A:
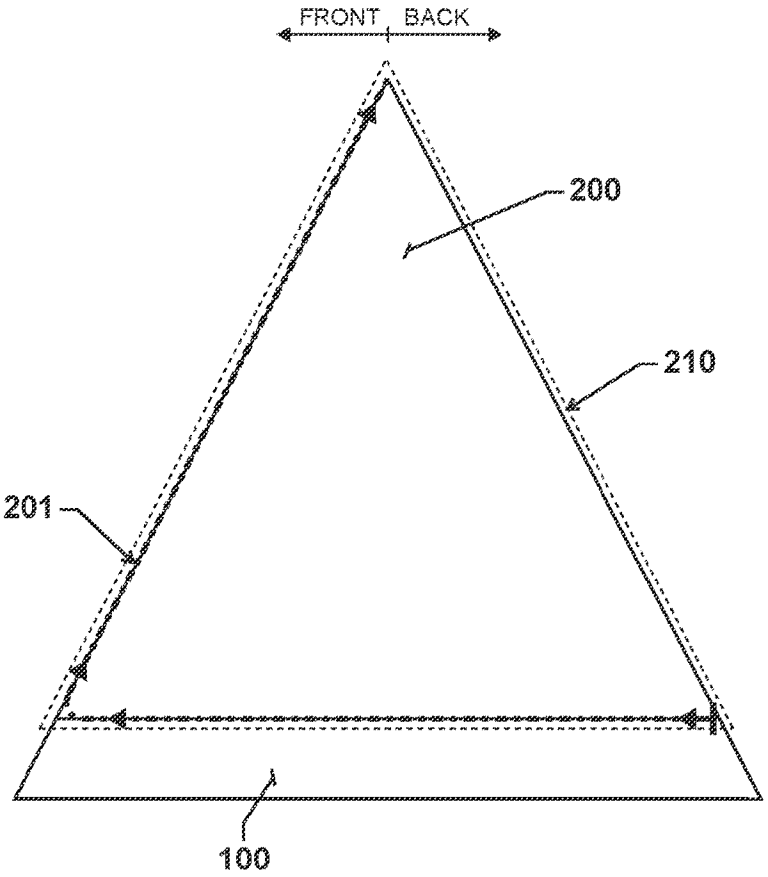
FIG. 13A shows a view of the right side of the outdoor shelter in a tent configuration, according to some embodiments of the present disclosure.
Figure 14:
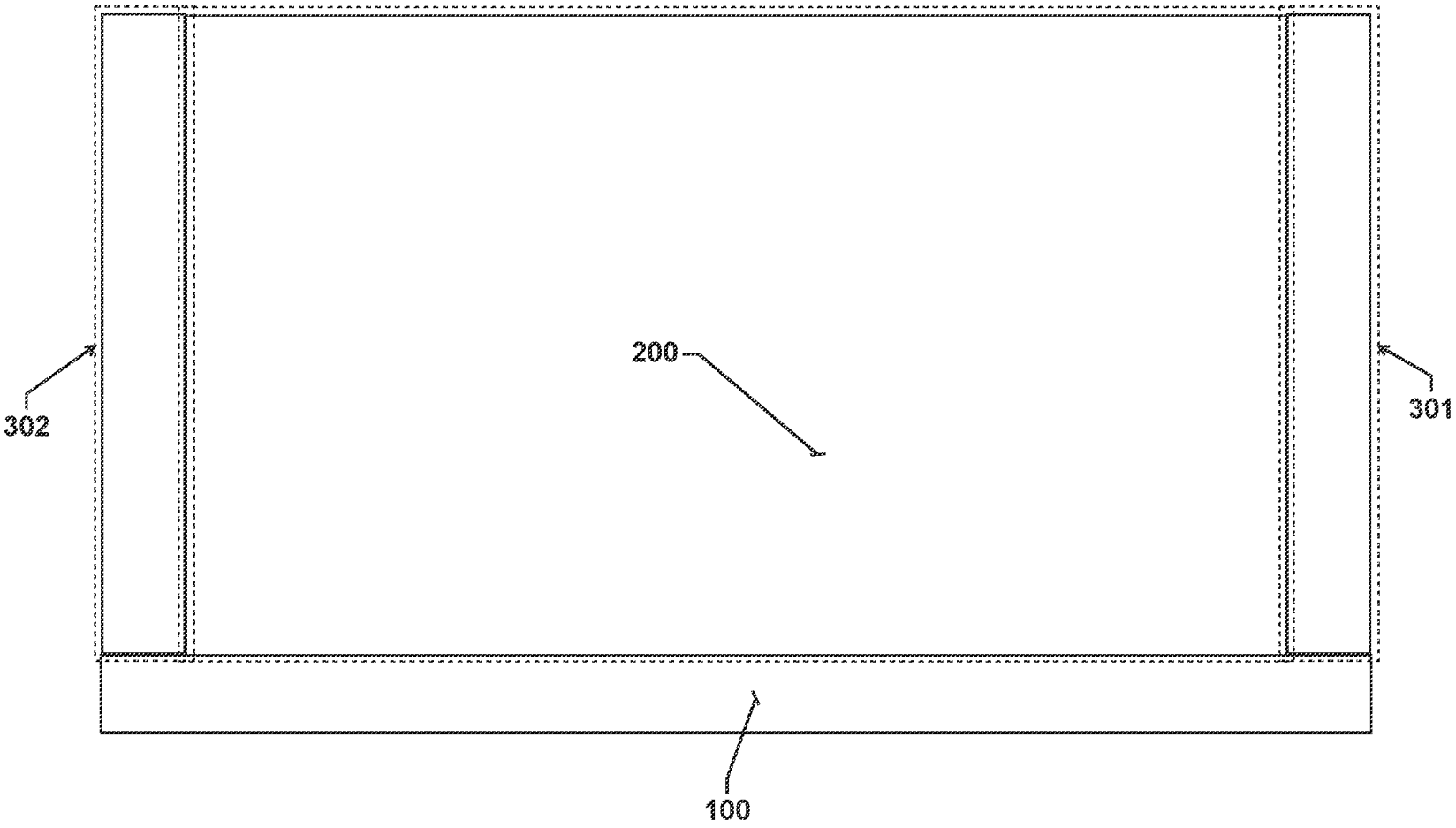
FIG. 14 shows a plan view of the enclosure, according to some embodiments of the present disclosure.

As illustrated in FIG. 13, the zippers 201 on the enclosure element 200 couples the base 100 to sides or portions of the enclosure element 200, in some embodiments. In this embodiment, the sides or portion of the enclosure element are not fully detachable. In some embodiments, one edge of the sides does not contain a zipper 201, allowing the user to wrap or roll the sides towards the non-detachable edge 210. The sides or portions of the enclosure element located at each a first end 301 and a second end 302, each end may be comprised of waterproof material. In some embodiments, as shown in FIG. 14, the sides or portions of the enclosure element 200 are comprised of mesh fabric and the peripheries of the sides are comprised of waterproof fabric.

Figure 15:
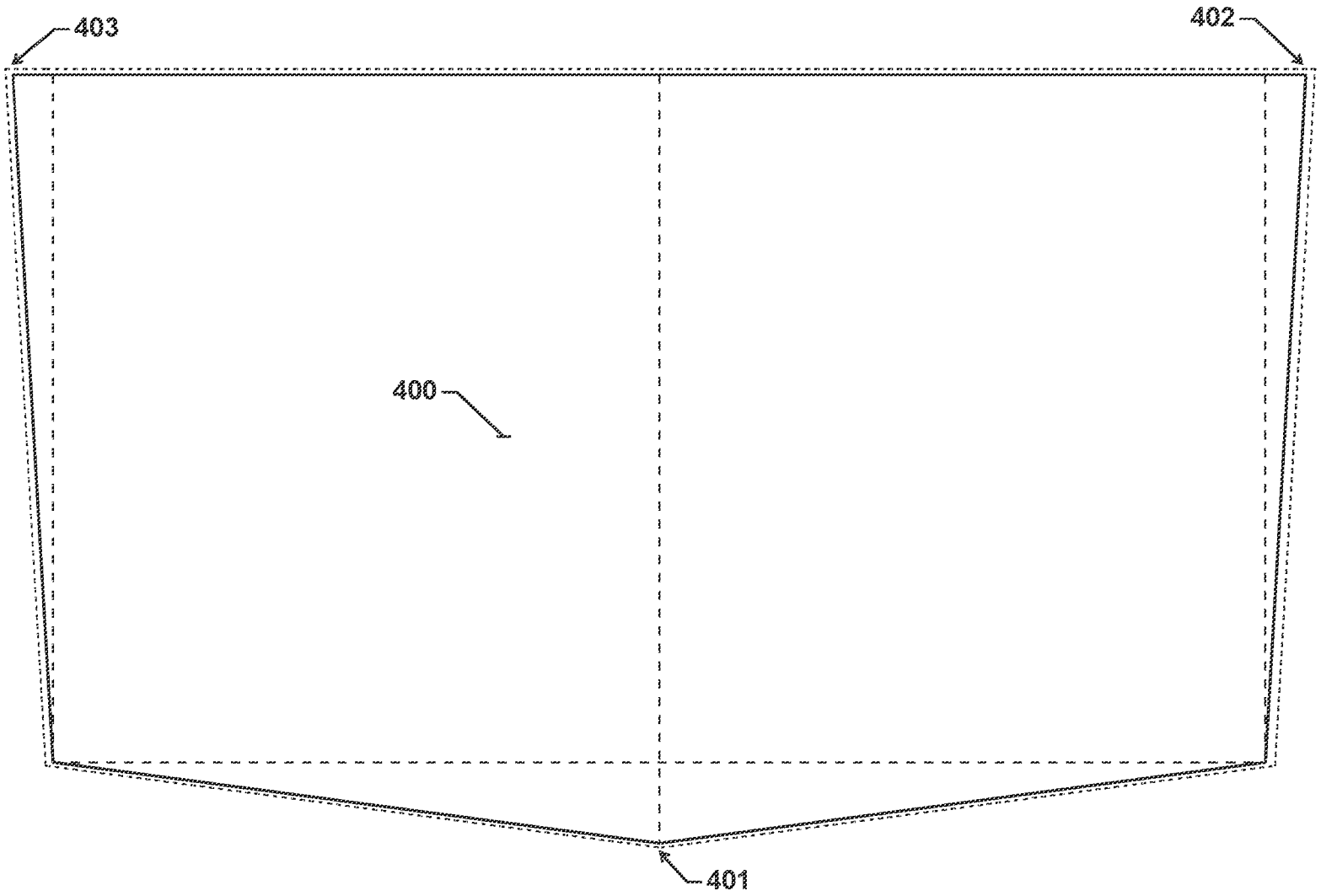
FIG. 15 shows a side view of the rainfly, according to some embodiments of the present disclosure.

The rainfly 400, according to the embodiment shown in FIG. 15, has dimensions exceeding the dimensions of the enclosure element 200 to provide waterproof coverage of the outdoor shelter. The bottom profile of the rainfly may be triangular shape, with the width of the rainfly at the centerline exceeding the width of the rainfly at its ends. In some embodiments, the length of the rainfly 400 at the top, where the rainfly connects with the first top strap and the second top strap, is larger than the length of the rainfly at the bottom.

Figure 16A:
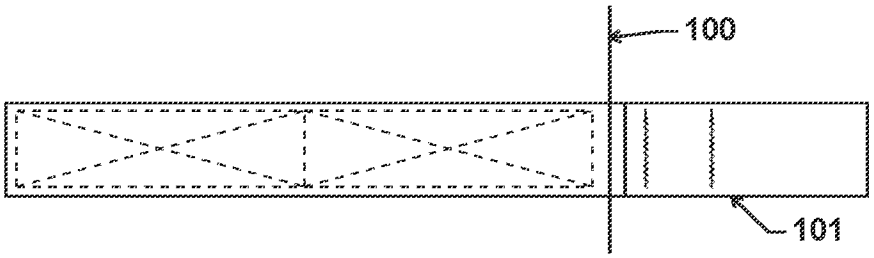
FIG. 16A shows an example of the base straps from a top view.
Figure 16B:
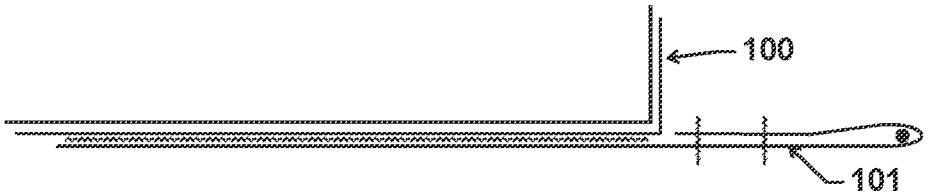
FIG. 16B shows an example of the base straps from a side view.

As shown in FIGS. 16A and 16B, the base 100 can also include a base strap 101 for securing ground or tent stakes. In this embodiment, the stitching pattern of the base strap 101 to the base 100 is designed to adequately support the user's applied loads. The base strap 101 may include a loop bar stitch pattern. As shown in FIG. 16, at the stitching location, the base 100 may be reinforced. A polyester or nylon cord loop may be used to couple the base strap 101 to the ground stakes.

Figure 17A:
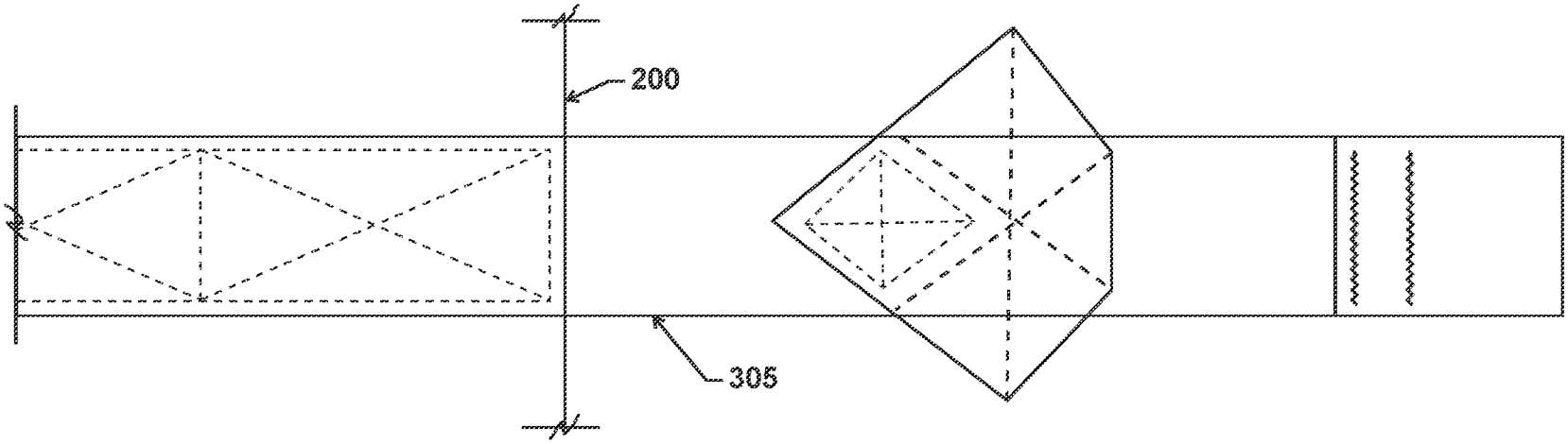
FIG. 17A shows a plan view of the top strap, according to some embodiments of the present disclosure.
Figure 17B:
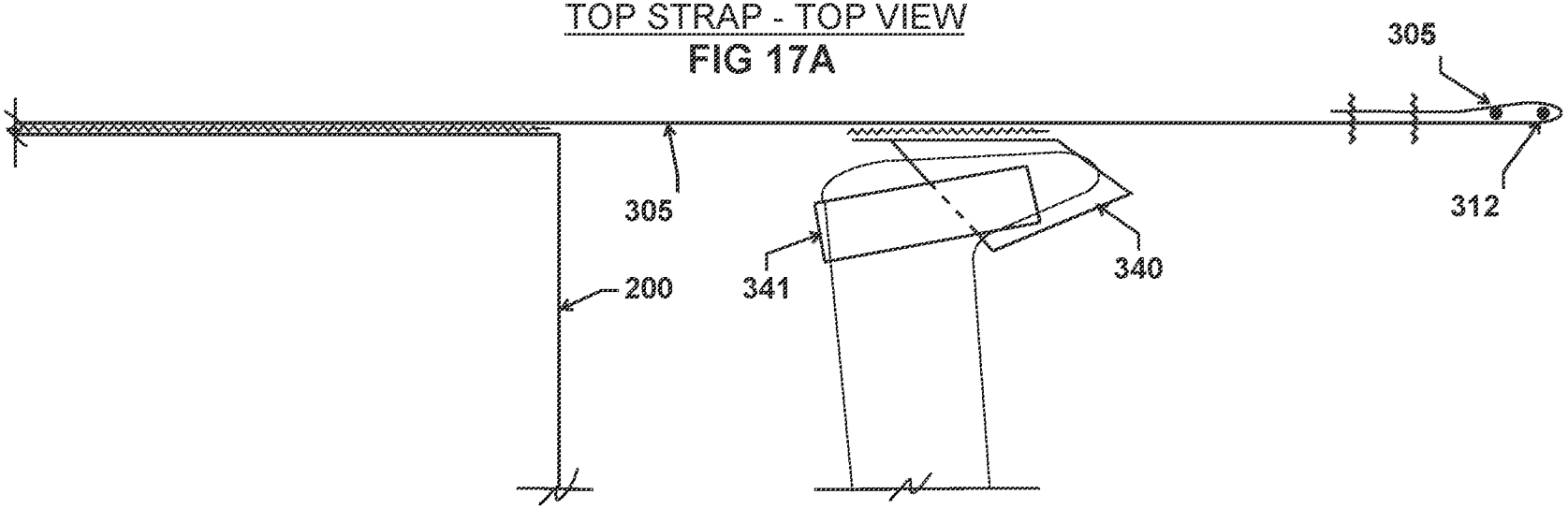
FIG. 17B shows a side view of the top strap, according to some embodiments of the present disclosure.

The first top strap 305 and the second top strap 306, as illustrated in FIG. 17A, can be constructed from nylon or polyester webbing. Each top strap is coupled to the enclosure element 200 via a lap stitch of sufficient length for support of applied loading, in some embodiments. As shown in FIG. 17B, the first top strap 305 and the second top strap 306 has a loop 340 configured to insert a trekking pole, according to one embodiment. Such loop may be constructed from webbing. In some embodiments, a flexible wrapping 341 is attached to the loop 340. The flexible wrapping 341 may comprise Velcro to detachably yet firmly secure the trekking pole to the loop 340. In some embodiments, the flexible wrapping is substantially orthogonal to the loop to conform to the general shape of the trekking pole. Furthermore, as shown in FIG. 17B, the first top strap 305 and the second top strap 306 may also have an additional pocket for inserting a first guyline 312, a second guyline 322, and the rainfly 400.

Figure 18A:
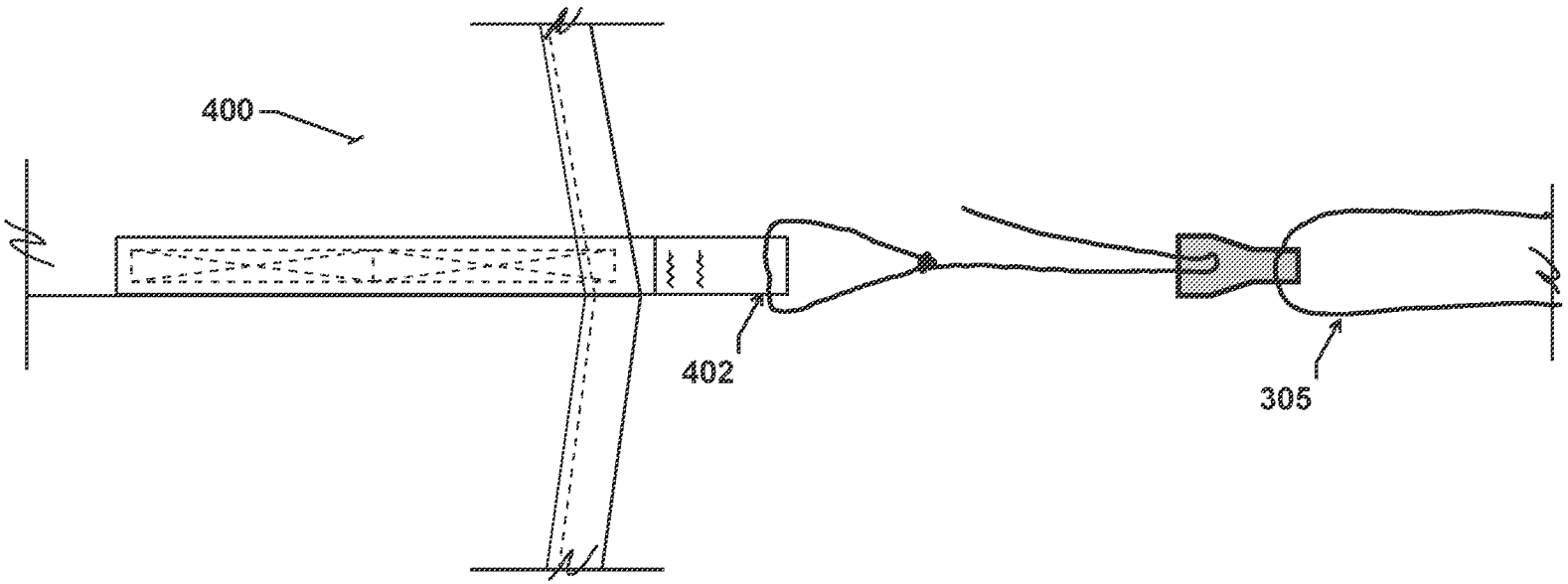
FIG. 18A shows a plan view of the rainfly connection, according to some embodiments of the present disclosure.
Figure 18B:
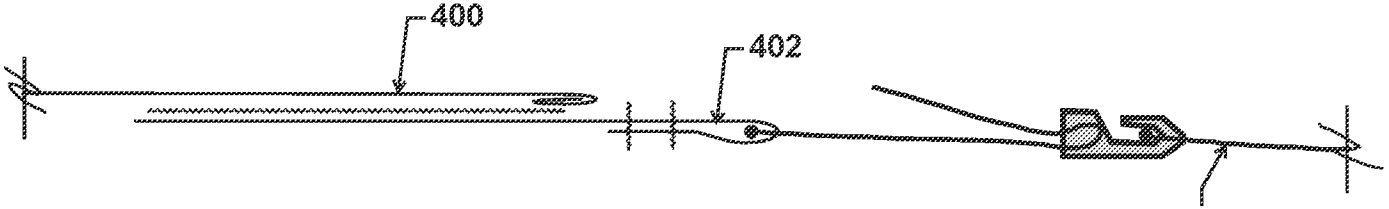
FIG. 18B shows a side view of the rainfly connection, according to some embodiments of the present disclosure.

The first attachment point 402 and the second attachment point 403, as shown in FIG. 18A, are coupled to the first top strap 305 and to the second top strap 306, in some embodiments. The attachment point may include a cord of adjustable length between the rainfly 400 and the connection to each of the first top strap 305 and of the second top strap 306. The adjustable feature of rainfly connection at each top strap allows the rainfly connection to be independent of the ridgeline 203, thus providing the outdoor shelter structure beneath to keep a gap as an additional level of protection from water seepage. The first attachment point 402 and the second attachment point 403 may be polyester or nylon webbing, with a loop at its end to insert the adjustable cord. In some embodiments, the rainfly 400 edge has a rolled seam. Furthermore, the first securing point 402 and the second securing point 403 may couple to the rainfly 400 via a webbing to fabric stitch pattern of sufficient strength to support the user-applied loads. In some embodiments, the connection of the first attachment point 402 and second attachment point 403 to the first top strap 305 and the second top strap 306, respectively, may be a hook.

An outdoor shelter, according to some embodiments of the present disclosure, can be used in an on-ground or in a suspended configuration. Such an outdoor shelter may include an enclosure element 200 having a base 100, and first sleeve 310 and second sleeve 320. Both the first sleeve 310 and the second sleeve 320 have a drawstring 304 which is looped through the sleeve, according to some embodiments. In one embodiment, each sleeve has a connection side 331 which is longer than an opposite side 338 of the first sleeve 310 and the second sleeve 320. The enclosure element may also have a first top strap 305 and a second top strap 306, which can be configured to engage a structural member 324. In some embodiments, the enclosure element has two top straps. In one configuration of the outdoor shelter, according to some embodiments, the base 100, and the first sleeve 310 and the second sleeve 320 are configured to lay flat upon an underlying surface. In such configuration, the enclosure 200 is configured to be vertically supported by structural members 324 engaged with each of the first top strap 305 and the second top strap 306, which can partially suspend the enclosure element 200. In another configuration of the enclosure element, each of the first and the second first sleeve 310 and the second sleeve 320 are bunched. In such configuration, the drawstring 304 in the first sleeve 310 is coupled to a lift point 311 and the drawstring 304 in the second sleeve is coupled to another lift point 321. In that configuration, the base 100 defines a catenary between the first lift point 312 and the second lift point 312.

In some embodiments, the enclosure element 200 also includes a first guyline 312 and a second guyline 322. Each guyline may have two extremities. According to some embodiments, one guyline 312 couples to one top strap 305 and an anchor point at the opposite extremity, and another guyline 322 couples to another top strap 306 and another anchor point at its opposite extremity.

According to some embodiments of the present disclosure, the outdoor shelter has a rainfly 400. Such rainfly 400 may have a first attachment point 402 and a second attachment point 403 and several securing points 401. In one configuration, the first attachment point of the rainfly 400 is coupled to one top strap 305 and the second attachment point of the rainfly is coupled to a second top strap 306. In such configuration, each of the securing points 401 of the rainfly 400 may be secured to anchor points such that the rainfly 400 vertically overhangs over a substantial portion of the enclosure element 200, according to some embodiments of the present disclosure. In a second configuration, the first attachment point of the rainfly 400 is coupled to one tie point and the second attachment point 403 is coupled to another tie point such that the rainfly 400 vertically overhangs over a substantial portion of the enclosure element 200 in a suspended configuration, according to some embodiments. In other embodiments, the rainfly 400 completely overhangs over the outdoor shelter in an on-ground configuration or in a suspended configuration.

According to some embodiments, the enclosure element 200 has a first end 301 and a second end 302. The first sleeve 310 may be coupled to the base 100 at the first end 301 and the second sleeve 320 may be coupled to the base 100 at the second end 302. The first top strap 305 is coupled to the enclosure element 200 at the first end 301 and the second top strap 306 is coupled to the enclosure element 200 at the second end 302, in some embodiments.

The enclosure element 200 may include zippers 201. The zippers 201 may couple portions of the enclosure element at the base 100. In some embodiments, the zippers are curved at the corners.

According to some embodiments, the enclosure element 200 is mesh material. The base 100 may be made from breathable polyester. Some embodiments of the present disclosure also include a carrying pouch that is designed to fit or accept the enclosure element 200. The carrying pouch may be made from a wide range of materials, including mesh and polyester. The carrying pouch may be waterproof. In some embodiments, the first sleeve 310 and the second sleeve 320 has a first entry point 332 and a second entry point 333 used to insert the drawstring 304; each entry point is not parallel with respect to the opposite entry point.

A sleeve system 310 for a hybrid tent and hammock, according to some embodiments, has a fabric loop 330, a connection end 331, an opposite end 338, a first entry point 332, a second entry point 333, and a drawstring 304. The connection end 331 may be longer than the opposite end 338. In some embodiments, the sleeve system 310 is used for coupling to a body of a hybrid tent and hammock at the connection end 331. The first sleeve 310 and the second sleeve 320 may be coupled to the base 100 of the hybrid tent and hammock or to other portions of the equipment. The fabric loop 330 couples at the connection end 331, according to some embodiments. The first sleeve 310 and the second sleeve 320 may also include a first entry point 332 and a second entry point 333 which may have reinforced ends 307. The reinforced ends 307 may prevent the first sleeve 310 and the second sleeve 320 from tears or failure when the sleeve is subjected to loading. The drawstring 304, according to some embodiments, extends through the first entry point 332, through the first sleeve 310 and the second sleeve 320, and through the second entry point 333. In some embodiments, the opposite end 338 has an opening that is configured to pass the drawstring 304 through the first sleeve 310 and the second sleeve 320 to the first entry point 332, to the second entry point 333, or both.

A hybrid tent and hammock, in some embodiments, includes an enclosure element 200. Such enclosure element 200 can comprise a base 100 having a first sleeve 310 and a second sleeve 320. In some embodiments, the base has a first sleeve 310 and a second sleeve 320 which are substantially parallel. In one configuration, the base 100 can extend horizontally upon an underlying surface and the sleeves lay flat. In such configuration, upon engaging a structural member 324, the enclosure element 200 defines an angle between the base 100 and suspended portion of the enclosure element. In another configuration, a cord is inserted or looped through the first sleeve 310 and another cord is inserted through the second sleeve 320. In this configuration, the sleeves are bunched and the cords are connected to a first lift point and a second lift point suspending the enclosure element and the base between the first sleeve 310 and second sleeve 320. In other embodiments of the present disclosure, the enclosure element has four sides with zippers. Each side is coupled to the base at the zipper and each side may be coupled to each other at the zippers. According to some embodiments, each side is configured to be rolled or opened according to the user's needs. The sides or a portion of the enclosure element 200 may be comprised of mesh material.

According to some embodiments, a hybrid tent and hammock includes a first top strap 305 and a second top strap 306. Such top straps are coupled to the enclosure element; the first top strap 305 is coupled to a first end in a direction opposite to the base 100 and the second top strap 306 is coupled to the second end in a direction opposite to the base 100, according to some embodiments. The hybrid tent and hammock may also include a first guyline 312 and a second guyline 322 coupled to the first top strap 305 and to the second top strap 306. In one configuration, a first guyline 312 is coupled to the first top strap 305 at one end and a first anchor point at the opposite end of the guyline, a second guyline 322 may be coupled to the second top strap 306 at one end and a second anchor point 315 at the opposite end of that guyline.

The first top strap and the second top strap, in some embodiments of the present disclosure, have a loop that is configured to insert a trekking pole and a flexible wrapping that is configured to detachably secure the trekking pole to the loop. In such embodiment, the flexible wrapping is coupled to the loop in a direction substantially orthogonal to the loop. The trekking poles may also be attached at different locations and through other methods.

In some embodiments, a hybrid tent and hammock has a detachable rainfly 400. Such rainfly 400 may include a first attachment point 402 and a second attachment point 403, and several securing points 401. In one configuration, the first attachment point 402 is coupled to the first top strap 305, the second attachment point 403 is coupled to the second top strap 306, and the securing points 401 are secured to anchor points such that the rainfly 400 vertically overhangs over a substantial portion of the enclosure element 200. In some embodiments, the rainfly vertically overhangs over the entire portion of the enclosure element 200, including the base 100. In a second configuration, the first attachment point 402 is coupled to a tie point, the second attachment point 403 is coupled to another tie point, and each securing point is secured to anchor points such that the rainfly 400 vertically overhangs over a substantial portion of the enclosure element 200. In this configuration the enclosure element 200 may be in a suspended or hammock configuration. In other embodiments, the rainfly 400 overhangs over the entire portion of the enclosure element 200 including the base 100. The base 100 may be comprised of breathable polyester in this embodiment. Furthermore, the hybrid tent and hammock may also include a carrying pouch that is designed to fit the enclosure element 200, as well as the top straps, sleeves, and drawstring 304.

What is claimed is:

1. An outdoor shelter for on-ground and suspended use comprising:

an enclosure element comprising a base;

a first sleeve and a second sleeve, each of the first sleeve and the second sleeve comprising:

a drawstring, wherein the drawstring is looped through a corresponding one of the first sleeve and the second sleeve; and a connection side and an opposite side, the connection side coupled to the enclosure element, wherein a length of the connection side is greater than a length of the opposite side;

a first top strap and a second top strap coupled to an upper portion of the enclosure element and configured to engage one or more structural members;

in a first configuration, the base is configured to lay flat upon an underlying surface, the first sleeve and the second sleeve lay flat, the upper portion of the enclosure element is configured to be vertically supported by a first structural member engaged with the first top strap and by a second structural member engaged with the second top strap, at least partially suspending the enclosure element;

in a second configuration, the first sleeve is bunched and the corresponding drawstring is coupled to a first lift point;

the second sleeve is bunched and the corresponding drawstring is coupled to a second lift point; and the base defines a catenary between the first lift point and the second lift point.

2. The outdoor shelter of claim 1, wherein the first top strap and the second top strap further comprises a first guyline and a second guyline;

in the first configuration, a first extremity of the first guyline is coupled to the first top strap and a second extremity of the first guyline is coupled to a first anchor point, a first extremity of the second guyline is coupled to the second top strap and a second extremity of the second guyline is coupled to a second anchor point.

3. The outdoor shelter of claim 1, further comprising a rainfly, the rainfly comprising a first attachment point and a second attachment point and a plurality of securing points;

in the first configuration, the first attachment point is coupled to the first top strap and the second attachment point is coupled to the second top strap, and each of the plurality of securing points are secured to anchor points such that the rainfly is configured to vertically overhang over a substantial portion of the enclosure element;

in the second configuration, the first attachment point is coupled to a first tie point and the second attachment point is coupled to a second tie point; and each of the plurality of securing points is secured to anchor points such that the rainfly is configured to vertically overhang over a substantial portion of the enclosure element.

4. The outdoor shelter of claim 1 wherein:

the first sleeve is coupled to the base at a first end and the second sleeve is coupled to the base at a second end;

the first top strap is coupled to the enclosure element at the first end and the second top strap is coupled to the enclosure element at the second end.

5. The outdoor shelter of claim 1, wherein the enclosure element further comprises a zipper, the enclosure element is coupled to the base at the zipper.

6. The outdoor shelter of claim 5, wherein the zipper further comprises curved zipper corners.

7. The outdoor shelter of claim 1, wherein the enclosure element further comprises of mesh material.

8. The outdoor shelter of claim 1, wherein the base further comprises a breathable polyester.

9. The outdoor shelter of claim 1, wherein the outdoor shelter further comprises a carrying pouch configured to accept the enclosure element.

10. The outdoor shelter of claim 1, wherein the first sleeve and the second sleeve each further comprise a first entry end and a second entry end, wherein each first entry end and second end are not parallel.

11. A hybrid tent and hammock comprising:

an enclosure element comprising a base; the base comprising:

a first sleeve and a second sleeve; wherein the first sleeve and the second sleeve are substantially parallel, in a first configuration, the base is configured to extend horizontally upon an underlying surface;

the first sleeve and the second sleeve lay flat;

upon engaging a structural member, the enclosure element defines an angle between the base and a suspended portion of the enclosure element;

in a second configuration, upon looping a first cord through the first sleeve and a second cord through the second sleeve, the first sleeve and the second sleeve are bunched, the first cord connects the first sleeve to a first lift point, and the second cord connects the second sleeve to a second lift point; and the base is suspended between the first sleeve and the second sleeve.

12. The hybrid tent and hammock of claim 11, wherein:

the enclosure element further comprises four sides;

each of the four sides comprising zippers adjacent sides of the four sides are coupled at the zippers; and upon opening the zippers, each of the four sides are configured to be rolled.

13. The enclosure element of claim 12, wherein the four sides comprise a mesh material.

14. The hybrid tent and hammock of claim 11, further comprising:

a first top strap and a second top strap, the first top strap is coupled to the enclosure element at a first end in a direction opposite to the base and the second top strap is coupled to the enclosure element at a second end in a direction opposite to the base;

a first guyline coupled to the first top strap;

a second guyline coupled to the second top strap;

in the first configuration, the first guyline is coupled is coupled to a first anchor point, and the second guyline is coupled to a second anchor point.

15. The hybrid tent and hammock of claim 14, wherein the first top strap and the second top strap further comprise:

a loop configured to insert a trekking pole; and a flexible wrapping configured to detachably secure the trekking pole to the loop, wherein the flexible wrapping is substantially orthogonally coupled to the loop.

16. The hybrid tent and hammock of claim 14, further comprising:

a rainfly comprising:

a first attachment point and a second attachment point;

a plurality of securing points;

in the first configuration, the first attachment point is coupled to the first top strap and the second attachment point is coupled to the second top strap, and each of the securing points is secured to anchor points such that the rainfly vertically overhangs over a substantial portion of the enclosure element;

in the second configuration, the first attachment point is coupled to a first tie point and the second attachment point is coupled to a second tie point;

each securing point is secured to anchor points such that the rainfly vertically overhangs over a substantial portion of the enclosure element.

17. The hybrid tent and hammock of claim 11, wherein the base further comprises breathable polyester.

18. The hybrid tent and hammock of claim 11, further comprising:

a carrying pouch configured to accept the hybrid tent and hammock.

* * * * *